US005278348A

United States Patent [19]

Eitaki et al.

[11] Patent Number: 5,278,348

[45] Date of Patent: Jan. 11, 1994

[54] MUSICAL-FACTOR DATA AND PROCESSING A CHORD FOR USE IN AN ELECTRONICAL MUSICAL INSTRUMENT

[75] Inventors: Shu Eitaki, Hamakita; Noriyuki Ueta; Noboru Akagawa, both of Hamamatsu, all of Japan

[73] Assignee: Kawai Musical Inst. Mfg. Co., Ltd., Shizuoka, Japan

[21] Appl. No.: 830,351

[22] Filed: Jan. 31, 1992

[30] Foreign Application Priority Data

Feb. 1, 1991 [JP] Japan ..... 3-012325
Feb. 1, 1991 [JP] Japan ..... 3-012327

[51] Int. Cl.[5] ..... G10H 1/38

[52] U.S. Cl. ..... 84/636; 84/610; 84/613; 84/614; 84/634; 84/637

[58] Field of Search ..... 84, 613, 637, 650, 669, 715, 609, 610, 611, 612, 602, 84/609–614, 615, 617, 618, 619, 634–637

[56] References Cited

U.S. PATENT DOCUMENTS 5,014,586 5/1990 Sakashita ..... 84/637
5,052,267 10/1991 Ino ..... 84/613
5,085,118 2/1992 Sekizuka ..... 84/637
5,153,361 10/1992 Kozuki ..... 84/637
5,155,286 10/1992 Saito et al. ..... 84/613

*Primary Examiner*—William M. Shoop, Jr.
*Assistant Examiner*—Helen Kim

[57] ABSTRACT

A device for use in an electronic musical instrument, in which data representing musical factors such as a tempo, a pitch and a timbre are changed at each repetition of an automatic performance, to thereby automatically effect variable automatic performances. Further, data representing a chord type and a chord root are input by a character-data input device such as a ten-key pad, and thus a chord input operation is facilitated, and moreover, a complicated finger manipulation becomes unnecessary. Furthermore, data representing chord types is input by at least one of the pitch input devices, and data representing chord roots is input by at least one of the other pitch input devices, and thus a chord performance is facilitated. Further, many types of chords can be performed, and moreover, the type and the root of a chord to be next performed, as well as those of a chord currently performed, are displayed, and thus the content of the chord to be next performed can be known in advance, whereby a chord performance can be smoothly effected.

20 Claims, 16 Drawing Sheets

FIG. 3

CHORD MEMORY 16

| NU-MERIC | KEY NUMBER | CHORD ROOT |
|---|---|---|
| 00 | A1 | A |
| 01 | A#1 | A# |
| 02 | B1 | B |
| 03 | C1 | C |
| 04 | C#1 | C# |
| 05 | D1 | D |
| 06 | D#1 | D# |
| 07 | E1 | E |
| 08 | F1 | F |
| 09 | F#1 | F# |
| 10 | G1 | G |
| 11 | G#1 | G# |

| NU-MERIC | KEY NUMBER | CHORD TYPE | NU-MERIC | KEY NUMBER | CHORD TYPE |
|---|---|---|---|---|---|
| 00 | C2 | □ | 23 | B3 | □7 (#9) |
| 01 | C#2 | □m | 24 | C4 | □7 (♭13) |
| 02 | D2 | □sus4 | 25 | C#4 | □7 (13/9) |
| 03 | D#2 | □♭5 | 26 | D4 | □7 (♭13/ ♭9) |
| 04 | E2 | □aug | 27 | D#4 | □7 (♭13/ #9) |
| 05 | F2 | □dim | 28 | E4 | □7 (#11/9) |
| 06 | F#2 | □6 | 29 | F4 | □7 (13/ ♭9) |
| 07 | G2 | □m6 | 30 | F#4 | □7 (♭13/9) |
| 08 | G#2 | □7 | 31 | G4 | □7 (13/#11/9) |
| 09 | A2 | □7sus4 | 32 | G#4 | □m7 (9) |
| 10 | A#2 | □m7 | 33 | A4 | □m7 (11/9) |
| 11 | B2 | □Δ7 | 34 | A#4 | □m7 (♭13) |
| 12 | C3 | □mΔ7 | 35 | B4 | □Δ7 (9) |
| 13 | C#3 | □7♭5 | 36 | C5 | □Δ7 (#11) |
| 14 | D3 | □m7♭5 | 37 | C#5 | □Δ7 (13) |
| 15 | D#3 | □aug7 | 38 | D5 | □Δ7 (13/9) |
| 16 | E3 | □add9 | 39 | D#5 | □mΔ7 (9) |
| 17 | F3 | □madd9 | 40 | E5 | □mΔ7 (♭5) |
| 18 | F#3 | □6 (9) | 41 | F5 | □m7♭5 (11) |
| 19 | G3 | □m6 (9) | 42 | F#5 | □7 (11/9) |
| 20 | G#3 | □7 (9) | 43 | G5 | □7 (13/11/9) |
| 21 | A3 | □7 (13) | 44 | G#5 | □ (13/ #11/9) |
| 22 | A#3 | □7 (♭9) | 45 | A5 | □dim (♭13) |

SEQUENSE INFORMATION

PROCES. : PROCESSINGS

SEQ. : SEQUENCE

FIG. 16

EXAMPLES OF DISPLAY AT LCD 7

(1) 7
```
00  Z&Roll  A7
```

(2) 7
```
00   Am   →  Eaug
```

(3) 7
```
00   E7
```

(4) 7
```
Transpose      +1
```

(5) 7
```
Overdrive      on
```

(6) 7
```
on=  <-1------7-9>
```

(7) 7
```
>  002-1-00  Adim
```

MUSICAL-FACTOR DATA AND PROCESSING A CHORD FOR USE IN AN ELECTRONICAL MUSICAL INSTRUMENT

BACKGROUND OF THE INVENTION

1. Field of the Invention

This invention generally relates to a musical-factor data changing device and a chord processing device for use in an electronic musical instrument. More particularly, this invention relates to an improved musical-factor data changing device for changing data representing a musical factor according to the contents of a sequence to be performed, and further, relates to an improved chord processing device by which a chord performance and a chord input operation are facilitated.

2. Description of the Related Art

Conventionally, in the technical field of electronic musical instruments, there is utilized an electronic musical instrument for storing sequence information, the information elements of which concerning performances are arranged in the performance order, for sequentially reading the sequence information and effecting an automatic performance by using the read sequence information. The sequence information comprises a plurality of elements of key number data and step-time data. The key number data represents pitches of musical tones; and the step-time data represents a time from a moment corresponding to the first note of a piece of music (i.e., the first note of the first bar of the piece of music) to another moment at which a sounding of a musical tone of the piece of music is started.

When effecting such an automatic performance, a player must preset musical-factor data (e.g., timbre data designating the timbre of each musical tone, transposition data, and tempo data denoting the tempo at which the music is performed) in an electronic musical instrument before an automatic performance is effected. Namely, prior to the automatic performance, the player must set the musical factors by turning on a timbre switch corresponding to a desired timbre and adjust a transposition knob or control and a tempo control, to thus set the desired data.

Where each musical factor is established prior to an automatic performance as above described, however, the musical factors are not changed but are fixed thereafter until the performance is completed. Consequently, the conventional electronic musical instrument encounters a problem in that the content of an automatic performance becomes monotonous.

Therefore, a countermeasure has been considered whereby, in the middle of an automatic performance, the timbre switch is placed in another position and/or the transposition control and the tempo control are operated, but it is very troublesome to carry out such a countermeasure in the middle of a performance. Further, it is necessary to timely perform such a countermeasure, because the content of the performance becomes unnatural if such a countermeasure is effected at a pause (e.g., an end of a bar) during a performance. It is very difficult, however, to timely effect such a countermeasure.

Furthermore, the conventional electronic musical instrument provides a function known as a fill-in function, i.e., a function of changing the content of an automatic performance of one phrase or two phrases in response to a depression of a fill-in button thereof in the middle of the performance. Nevertheless, the content of the performance returns to the original content thereof after such a fill-in performance (i.e., the performance using the fill-in function) is completed. Moreover, the fill-in button must be operated for executing the fill-in function, and thus the conventional electronic musical instrument encounters another problem in that the execution of the fill-in function is troublesome.

Further, various devices to be employed in the conventional electronic musical instrument for the facilitating of a chord performance have been proposed. For example, a device for performing an automatic chord-form performance has been proposed whereby the automatic chord-form performance is effected by automatically repeating a chord performance by continuing to press (or by once pressing) each of the keys of an accompaniment portion of a keyboard corresponding to the musical tones of a chord, while an automatic rhythm performance is effected.

Another proposal is for a device for effecting a one-finger chord performance. An this device, the one-finger chord performance is effected by automatically repeating a performance of a type of chord (e.g., a major triad) by continuing to press (or by once pressing) a key of an accompaniment portion of a keyboard corresponding to a root of the chord, while an automatic rhythm performance is effected and, for example, the type of chord to be performed is changed according to the number of pressed keys, explained below. Namely, the type of chord is changed to a minor triad by simultaneously continuing to press (or only once pressing) another key together with the key corresponding to the root of the major triad, and then the type of chord is further changed to a seventh chord by simultaneously continuing to press (or only once pressing) still another key together with the keys respectively corresponding to the minor triad.

The automatic chord-form performance can be effected by only turning on each of keys corresponding to musical tones composing a chord to be performed, and thus it is not necessary to repeat an on-and off-operation of each of the keys. Consequently, a chord performance and/or a chord input operation can be facilitated. A problem remains, however, in that all of the keys composing the chord must be pressed, and thus the finger manipulation becomes difficult. In contrast, when performing the one-finger chord performance, the finger manipulation becomes easier. A problem arises, however, in that the number of types of chords available cannot be more than the number of fingers, and thus is five at most.

SUMMARY OF THE INVENTION

The present invention has been created in order to resolve the above described problems of the conventional electronic musical instrument.

Accordingly, an object of the present invention is to provide a musical-factor data changing device for use in an electronic musical instrument, by which data representing musical factors such as timbres, pitches and tempos employed for an automatic performance can be automatically changed without a complicated operation, whereby various automatic performances can be easily realized.

The present invention is intended to resolve the problems of the conventional devices, and therefore, another object of the present invention is to provide a chord processing device by which a chord performance and- /or a chord input operation is facilitated and the performance of many types of chords is realized.

To achieve these objects, in accordance with an aspect of the present invention, there is provided a musical-factor data changing device for use in an electronic musical instrument, this device comprising storage means for storing performance information, reading means for reading the performance information from the storage means, performance means for performing a piece of music according to the read performance information, repeating means for causing the reading means to repeat a reading of the performance information and changing means for changing data representing a musical factor associated with the performance information at each repetition of a reading of the performance information made by the repeating means.

In accordance with another aspect of the present invention, there is provided a chord processing device which comprises character-data input means for inputting character data, first conversion means for converting the character data input by the character-data input means into chord type data representing a type of a chord to be performed, second conversion means for converting the character data input by the character-data input means into chord root data representing a root of the chord, first output means for outputting the chord type data obtained by the first conversion means, and second output means for outputting the chord root data obtained by the second conversion means.

In accordance with a further aspect of the present invention, there is provided a chord processing device which comprises a plurality of pitch input means for inputting pitch data, chord-type conversion means for converting the pitch data input by at least one of the pitch input means into chord type data representing a type of a chord to be performed, chord-root conversion means for converting the pitch data input by at least one of the other pitch input means into chord root data representing a root of the chord, and output means for outputting the chord type data obtained by the chord-type conversion means and for outputting the chord root data obtained by the chord-root conversion means.

In accordance with still another aspect of the present invention, there is provided a chord processing device which comprises chord storing means for storing chord type data representing types of chords and chord root data representing roots of chords, first reading means for reading the chord type data and the chord root data from the chord storing means according to a progress of a performance, first display means for displaying the chord type data and the chord root data read by the first reading means, second reading means for reading chord type data and chord root data respectively subsequent to the chord type data and the chord root data read by the first reading means, and second display means for displaying the chord type data and the chord root data read by the second reading means.

BRIEF DESCRIPTION OF THE DRAWINGS

Other features, objects and advantages of the present invention will become apparent from the following description of a preferred embodiment with reference to the drawings, in which like reference characters designate like or corresponding parts throughout several views, and in which:

FIG. 3 is a diagram showing the content of a chord memory 16;

FIG. 16 is a diagram showing examples of a display image displayed by a liquid crystal display (LCD) 7.

DESCRIPTION OF THE PREFERRED EMBODIMENT

Hereinafter, a preferred embodiment of the present invention will be described in detail, with reference to the accompanying drawings.

Before explaining the preferred embodiment in detail, an outline of this embodiment will be given hereinbelow.

Figure 11:
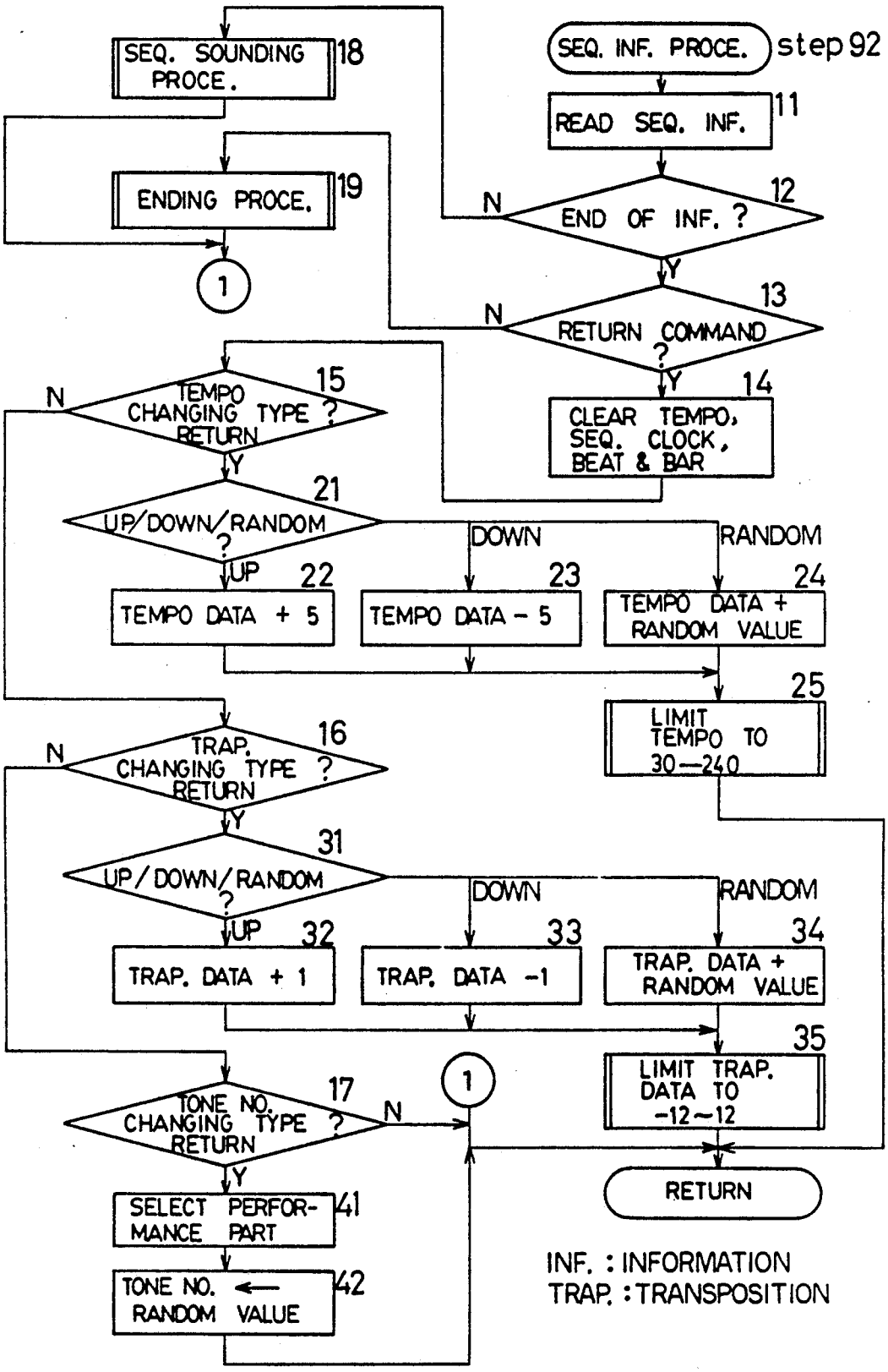
FIG. 11 is a flowchart of a subroutine for performing a sequence information processing of a step 92 of the main routine.
Figure 12:
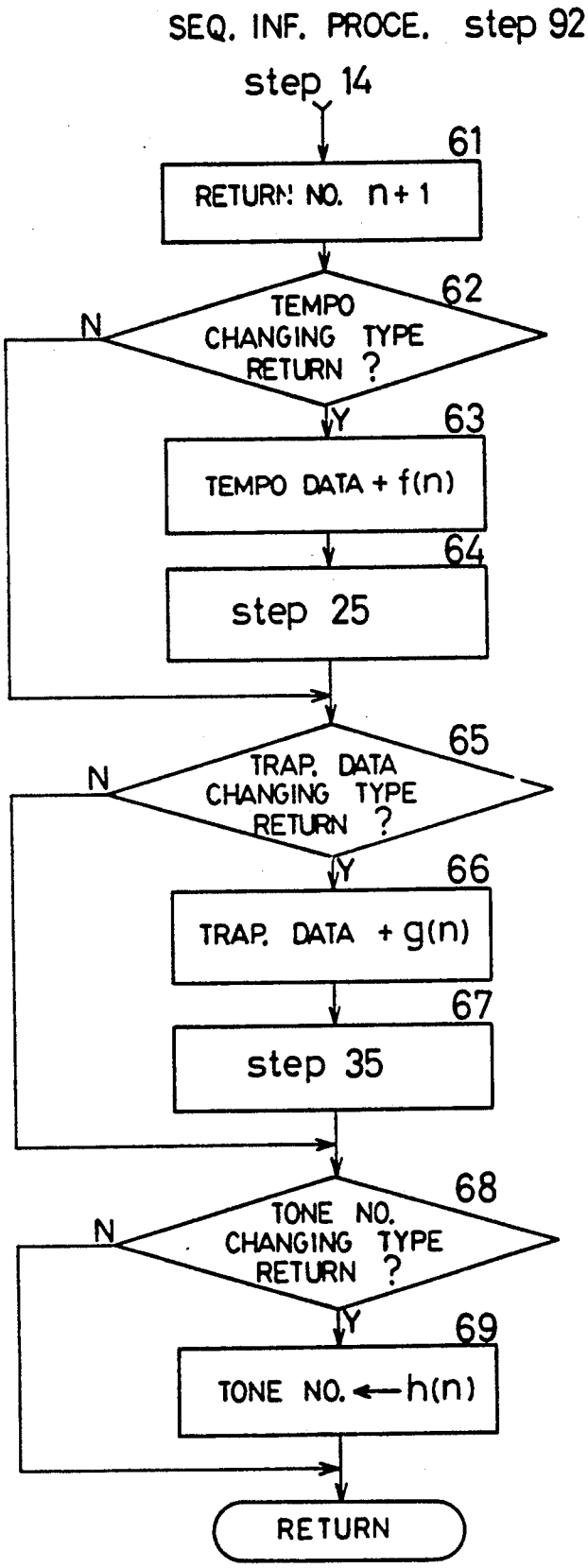
FIG. 12 is a flowchart of another subroutine for performing the sequence information processing.

As shown in FIGS. 11 and 12, where a RETURN command for directing a repetition of a performance is read (in step 13) while sequence information is being read, the tempo data is changed (in steps 22 to 24 and 63) and the transposition data is changed (in steps 32 to 34 and 66), and the tone number data representing timbres is also changed (in steps 41, 42 and 66), according to the contents of the RETURN command (see steps 15 to 17, 21, 31, 62, 65 and 68).

Figure 9:
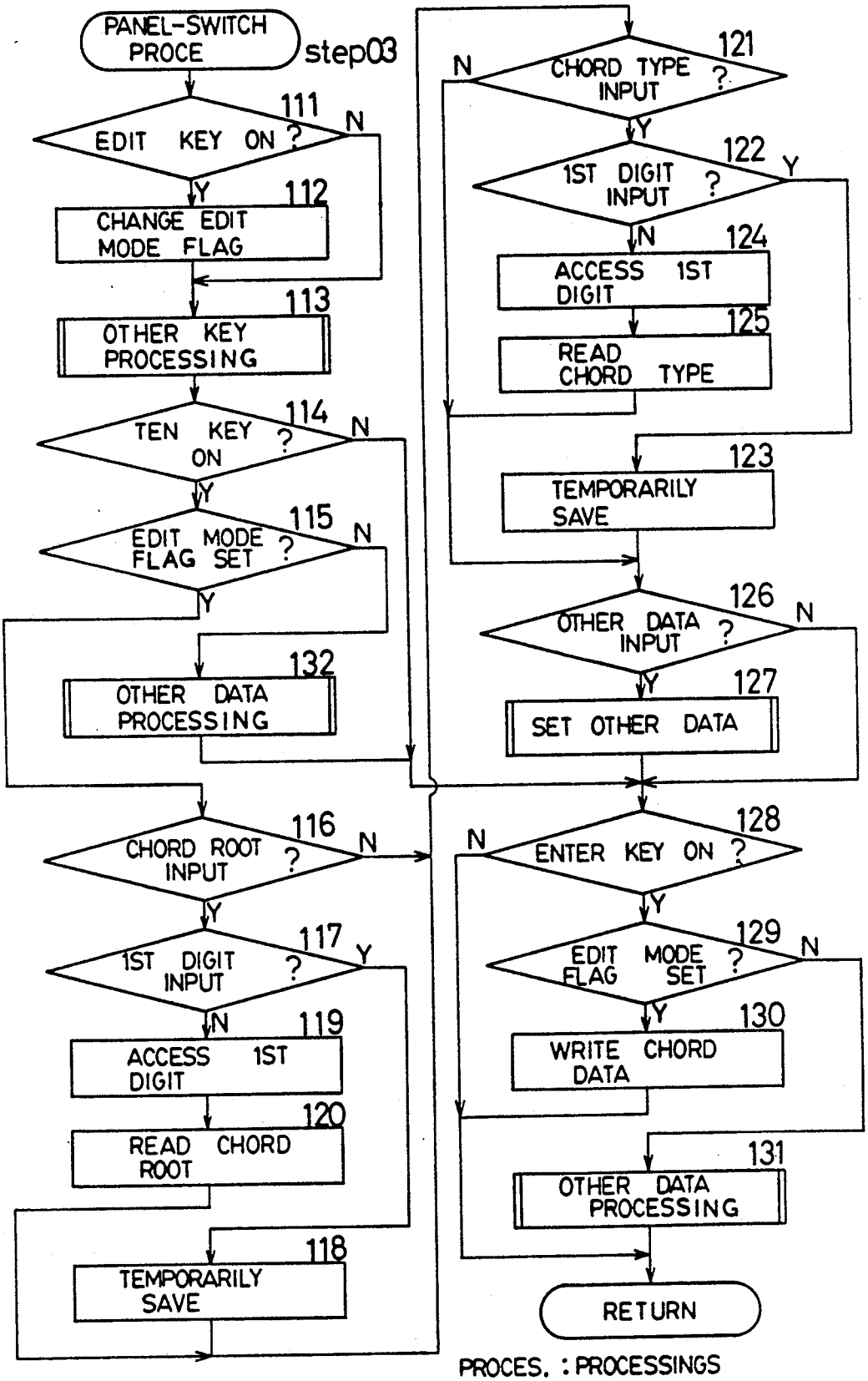
FIG. 9 is a flowchart of a subroutine for performing a panel switch processing of a step 03 of the main routine.
Figure 13:
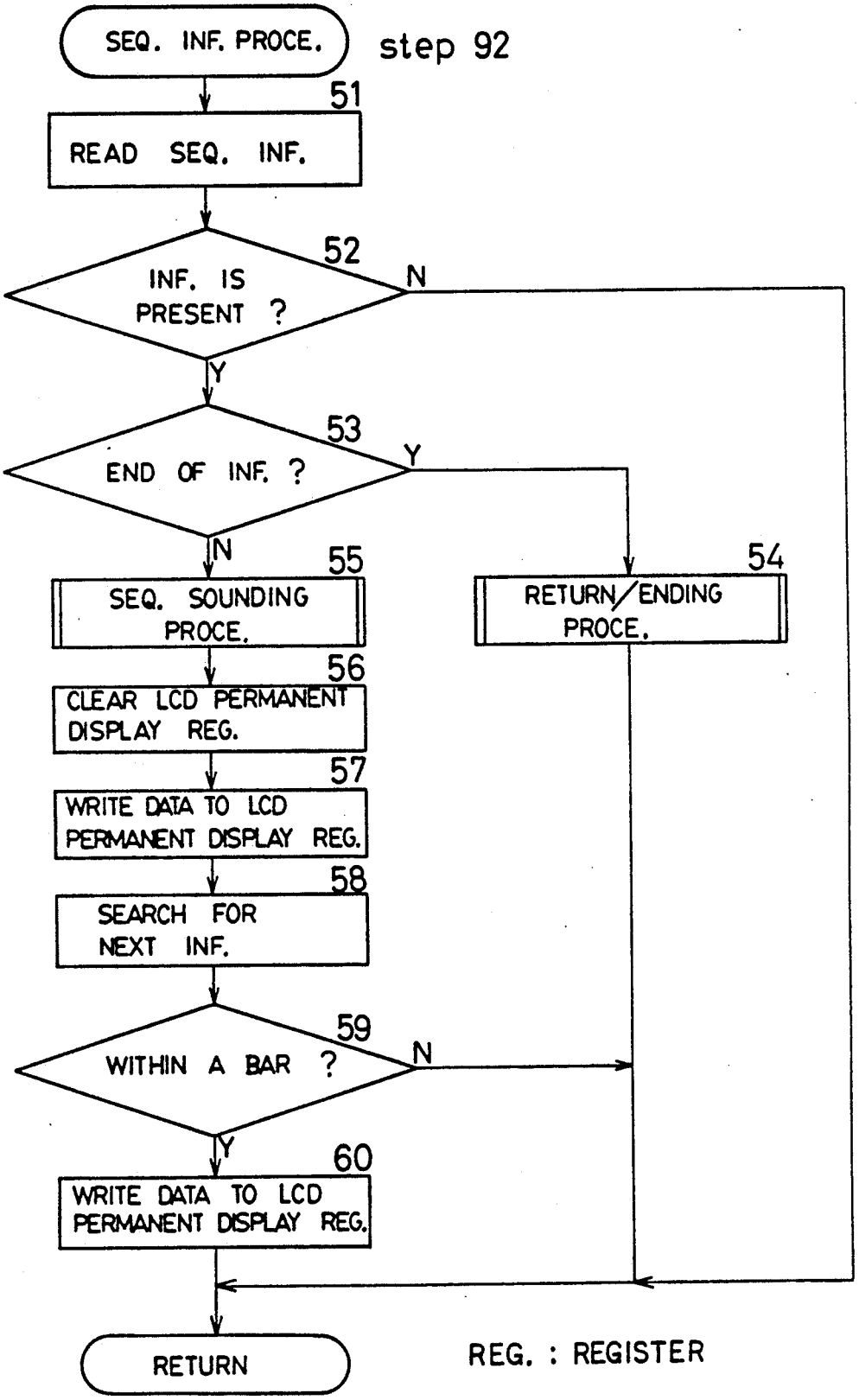
FIG. 13 is a flowchart of still another subroutine for performing the sequence information processing.
Figure 14:
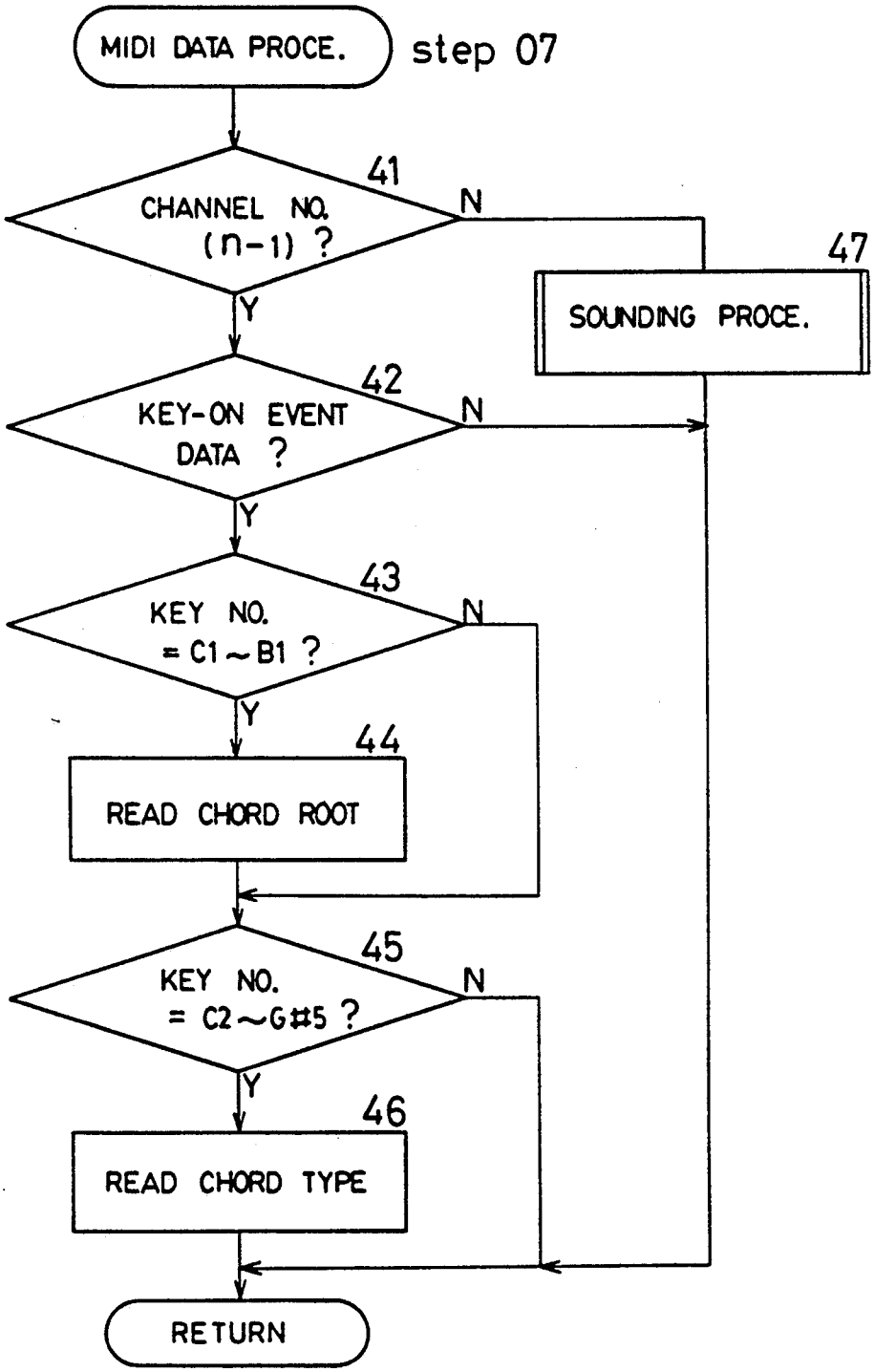
FIG. 14 is a flowchart of a subroutine for performing a musical-instrument-digital-interface (MIDI) data processing of a step 07 of the main routine.

Further, as shown in FIGS. 9, 13 and 14, chord root data and chord type data corresponding to numerical data and key number data are read from a chord memory 16 of FIG. 3 (in steps 120, 125, 44 and 46) and are output as chord data. Furthermore, data representing a chord currently performed (see steps 51 and 57), as well as data representing another chord to next be read (see step 58), are read (in step 58) and are displayed (in step 60).

1. Entire Circuit

Figure 1:
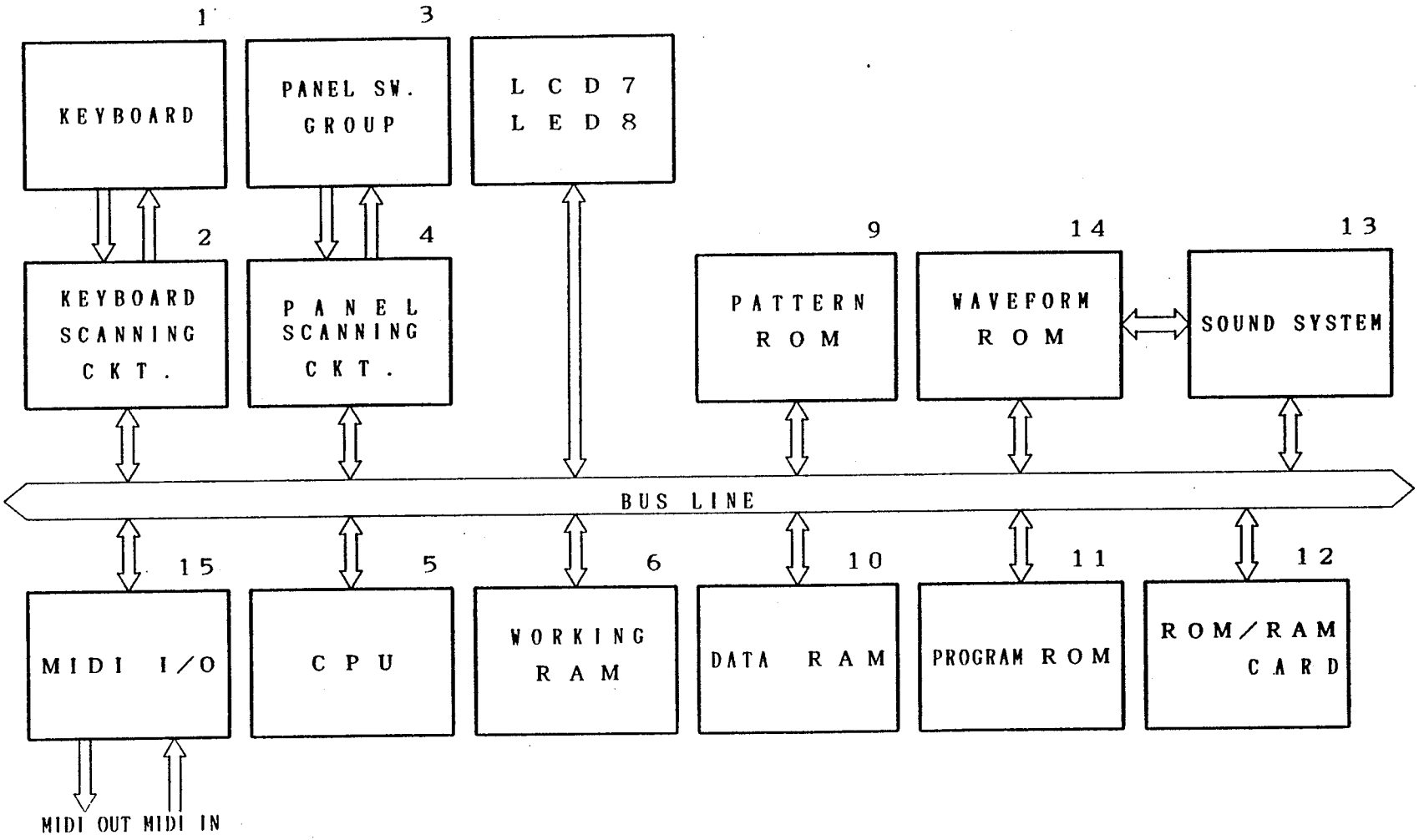
FIG. 1 is a circuit diagram showing an entire electronic musical instrument.

FIG. 1 shows the construction of an entire circuit of an electronic musical instrument according to the present invention, wherein each key of a keyboard 1 is scanned by a key scanning circuit 2, to detect data representing a key-on state (i.e., an on-state) or a key-off state (i.e., an off-state) of each key. The detected data is then written by a central processing unit (CPU) 5 to a working RAM 6 and compared with data previously stored in the working RAM 6, which data also represents a key-on state or a key-off state of each key, and it is determined by the CPU 5 from the results of this comparison whether an on-event or an off-event has occurred at each key. Note, the keyboard 1 may be replaced with an electronic string instrument, an electronic wind instrument, an electronic percussion instrument, or a keyboard of a computer system or the like.

Each key of a panel switch group 3 is scanned by a panel scanning circuit 4, whereby data representing an on-state or an off-state of each key is detected and written by the CPU 5 to the working RAm 6. The written data is compared with data previously stored in the working RAM 6, which data represents an on-state or an off-state of each key, and it is determined from the results of this comparison by the CPU 5 whether an on-event or an off-event has occurred at each key. The above described data and other processing data are sent to an LCD 7 and a light emitting diode (LED) 8, whereupon a display image is displayed according to the content of the data.

Sequence information such as rhythm, bass, backing, arpeggio, chord and melody information required for an automatic performance of a plurality of pieces of music is stored in a pattern read-only memory (ROM) 9. Further, a ROM/RAM card 12 containing a ROM and/or a RAM is utilized, and the above-described sequence information and waveform data are stored in the ROM/RAM card 12. The sequence information is also stored in a data RAM 10. Note, the sequence information includes the information sent from the pattern ROM 9 and the ROM/RAM card 12, information obtained by performing an arrangement by modifying the information sent therefrom, and information newly created by a player. A sequence performance processing to be performed in step 05, as described later, is effected on the basis of the sequence information stored in the pattern ROM 9, the data RAM 10 or the ROM/-RAM card 12.

Programs shown by later-described flowcharts, to be executed by the CPU 5 for performing various processes, are stored in a program ROM 11. A chord decoder and a chord memory 16 are formed and other kinds of information is stored in this program ROM 11. When chord data indicating the type (hereunder sometimes referred to as the chord type) and the root (hereunder sometimes referred to as the chord root) of a chord is input to the chord decoder, data corresponding to key number data representing musical tones composing the chord are read therefrom. Conversely, when numerical data or key number data is input to the chord memory 16, as illustrated in FIG. 3, data indicating the chord type and the chord root of a corresponding chord are read therefrom.

A sound system 13 generates a musical sound signal, which corresponds to a pitch corresponding to a turned-on key of the keyboard 1, a velocity at the time of effecting a key-on or key-off operation, and a timbre corresponding to a turned-on switch of the panel switch group 3. Note, the term velocity refers to data indicating a speed or strength at which a sounding operation (i.e., a depressing) of each key of the keyboard 1 is performed. In the sound system 13, musical-sound generating systems of a plurality of channels (e.g., 16 channels) are formed by performing a time-sharing processing, whereby a polyphonic sounding of musical sounds can be performed. Data concerning a musical sound assigned to each channel is stored in an assignment memory (not shown).

Various kinds of waveform data are read by this sound system 13 from a waveform ROM 14, this waveform data correspond to the pitches, the velocities and the timbres. A MIDI interface 15 is employed to receive musical-sound data from and transmit musical-sound data to another electronic musical instrument (hereunder referred to as an external electronic musical instrument) connected to the electronic musical instrument of FIG. 1. The musical-sound data is generated according to the MIDI specification. Further, a sounding of a musical tone based on the musical-sound data is also effected in the sound system 13.

2. Panel Switch Group 3

Figure 2:
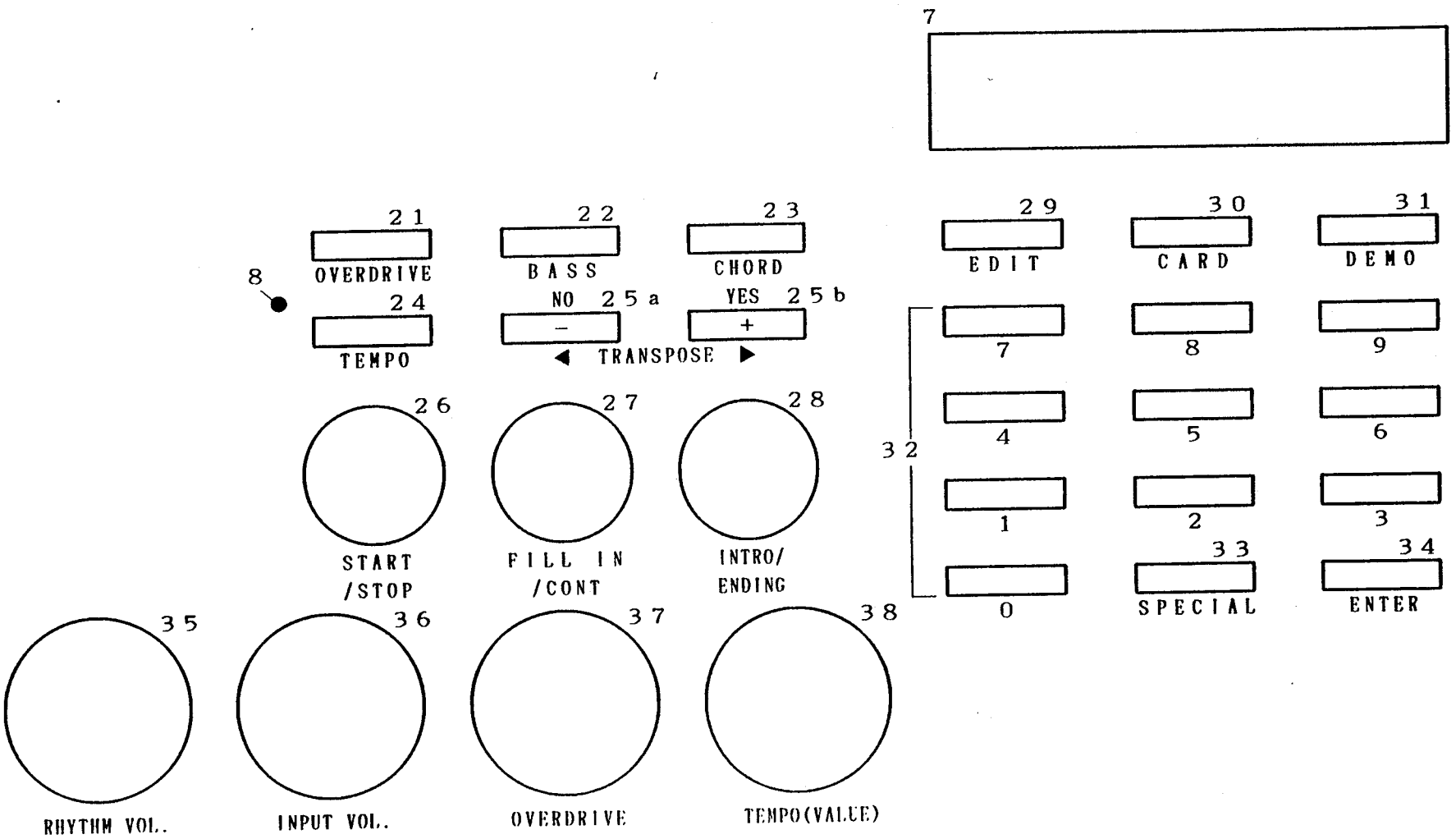
FIG. 2 is a diagram showing each of keys 21 to 34 of a panel switch group and volumes 35 to 38.

FIG. 2 shows the panel switch group 3, the LCD 7 and the LED 8. As shown in this figure, the panel switch group 3 is comprised of an OVERDRIVE key 21, a BASS key 22, a CHORD key 23, a TEMPO key 24, a "−" key 25*a*, a "+" key 25*b*, a START/STOP key 26, a "FILL IN/CONT" key 27, an INTRO/ENDING key 28, an EDIT key 29, a CARD key 30, a DEMO key 31, ten keys 32 respectively corresponding to 0 to 9, a SPECIAL key 33, an ENTER key 34, and four volume controls 35, 36, 37, and 38.

The OVERDRIVE key 21 is used to effectuate or suppress the overdrive effect (hereunder referred to simply as an overdrive) of the external electronic musical instrument connected to the instrument of FIG. 1. The term overdrive refers to a kind of musical effect whereby a clipping distortion used for clipping a peak of a waveform of a musical sound is obtained. The BASS key 22 is used to control the volume of a bass part of a performance, and the CHORD key 23 is used to control the volume of a chord part and that of a backing part of a performance. The TEMPO key 24 is used to make the instrument of FIG. 1 produce an established tempo.

The "+" key 25*a* and the "−" key 25*b* are used to effect a transposition by lowering or raising each pitch of original music by an integral multiple of a semitone within an entire compass of the keyboard 1, to move a display cursor of the LCD 7, and to indicate "YES" (i.e., "Execute") or "NO" (i.e., "Do not execute") while each of the programs for performing various processes is executed. The START/STOP key 26 is used to start and stop an automatic performance based on the sequence information. The FILL IN/CONT key 27 is used to change only short phrases of bass and chord parts during a performance, and to hold an automatic performance mode during a suspension of a performance, and thereafter, to resume the automatic performance. The INTRO/ENDING key 28 is used to play an introduction phrase of a piece of music at the beginning of a performance of the piece of music and an ending phrase of the piece of music at the end of the performance of the piece of music. The EDIT key 29 is used to indicate a mode of inputting the sequence information, or another mode of modifying the sequence information.

The CARD key 30 is used to indicate an access to the ROM/RAM card 12. The DEMO key 31 is used to indicate a demonstration performance. The ten-keys 23 are used to select a song number from the sequence information on a plurality of pieces of music, and to input various data indicating kinds of chords and timbres and values of various kinds of commands. The SPECIAL key 33 is operated together with the ten-keys 32 to enter various modes, and to release the various modes. The ENTER key 34 is used to indicate the input data and direct an execution of a command. The volume controls 35 to 38 are used to set the volume of sounds of a rhythm part, the volume of sounds of the external electronic musical instrument connected to the instrument of FIG. 1, a depth of the overdrive, and a value of a tempo.

When the SPECIAL key 33 and one of the ten-keys 32 are simultaneously pressed, the instrument of FIG. 1 is placed in a mode in which the modified content of the data indicating the musical factors is set. This mode is released by turning on only the SPECIAL key 33. In this mode, by operating the volume control 38, the "−" key 25*a* or the "+" key 25*b*, the modified content of the data indicating the musical factors (i.e., an increase in value indicated by tempo data, a decrease in value indicated by the tempo data, an addition of a random value to the value indicated by the tempo data, a decrease in value indicated by transposition data, an addition of a random value to the value indicated by the transposition data, and a change of a value indicated by tone number (or timbre) data into a random value) are selected.

By operating the ten keys 32 as described-above, the sequence information of 10 pieces of music corresponding to song numbers 90 to 99 (to be described later) is selected. Further, by operating the EDIT key 29, other keys 21 to 34 and the volume controls 35 to 38, an EDIT mode of inputting and modifying a chord root and a chord type indicated by the sequence information is established. As illustrated in FIG. 16(7), the input or modified chord is also displayed in this mode. Note, in the example of FIG. 16(7), a performance chord is charged to Adim (A diminished) at step 00 ("00") of a first beat ("1") of a second bar ("002"), and further, a step is obtained by dividing one beat by 48, i.e., the number of steps per beat is 48.

The numbers of bars, beats and steps are set by moving the display cursor by using the "−" key 25*a* and the "+" key 25*b* and then inputting desired values by using the ten keys 32. The chord root and the chord root are also set by moving the display cursor by using the "−" key 25*a* and the "+" key 25*b* and then inputting desired data by using the ten keys 32. The desired data are as illustrated in FIG. 3. In this case, the keyboard 1 may be used instead of the ten keys 32.

When the SPECIAL key 33 and another of the ten-keys 32 are simultaneously pressed, the instrument of FIG. 1 is placed in a mono-chord mode, which can be released by turning on only the SPECIAL key 33. In this mode, only one chord is played by effecting an automatic performance. Further, the chord is not changed in the middle of the mono-chord mode, but when key number data is input through the MIDI interface 15, the chord to be played is changed to a chord corresponding to the key number data. Note, the chord to be played may be changed to a chord corresponding to key number data input from the keyboard 1 or another chord corresponding to numerical data input through the ten keys 32. Also, even during a manual performance, a chord performance may be effected by inputting data indicating a chord, from the ten keys 32 or the keyboard 1.

When the SPECIAL key 33 and still another of the ten-keys 32 are simultaneously pressed, the instrument of FIG. 1 is placed in a MIDI mode, which can be released by turning on only the SPECIAL key 33. In this MINI mode, a receiving channel number is set. Namely, musical-sound data such as key number data is received through the MIDI interface 15 at a receiving channel corresponding to the receiving channel number, and key number data received by a channel having a number which is lower than the receiving channel number by 1 is sent to the chord memory 16, whereupon the key number data is converted into a chord.

Input data or an input command corresponding to an operated keys 21 to 34 or volume controls 35 to 38 is variably displayed by the LCD 7 only for a constant time from that at which one of the keys 21 to 34 and the volume controls 35 to 38 is operated. During an automatic performance, a chord to be currently performed, as well as another chord to be next performed, is displayed by the LCD 7. The LED 8 blinks at a speed corresponding to the established tempo. Further, a slot is provided, to which the ROM/RAM card 12 is inserted, together with a connector for the MIDI interface 15.

3. Chord Memory 16

FIG. 3 shows the content of the chord memory 16 formed in the program RAM 11. When 2-digit numerical data is input to the chord memory 16, chord data comprised of data elements representing a chord root and a chord type corresponding to the numerical data are read therefrom. In this case, numerical values 00 to 11 correspond to both the chord root and the chord type when overlapped, and one of the chord root and the chord type is selected by changing a mode by operating the keys 21 to 34 and the volume controls 35 to 38. Note, such an overlap can be prevented by assigning numerical values of from 20 to 65 to the chord types. Here the numerical value data is input from the ten keys 32 of the panel switch group 3, but it can be input from the external electronic musical instrument through the MIDI interface 15.

Even when key number data representing pitches C1 to A5 are input to the chord memory 16, chord data composed of data elements representing a chord root and a chord type are read therefrom, and in this case, key number data indicating the pitches C1 to B1 corresponding to both the chord root and the chord type is overlapped. One of the chord root and the chord type may be selected by changing a mode by operating the keys 21 to 34 and the volume controls 35 to 38. The key number data is input from the external electronic musical instrument through the MIDI interface 15, and are further input from the keyboard 1. In this case, to distinguish such key number data from ordinary key number data, the key number data input through the MIDI interface is input by using a specific MIDI channel. Further, the key number data input from the keyboard 1 is distinguished from the ordinary key number data by changing a mode by operating the keys 21 to 34 and the volume controls 35 to 38.

4. Data Ram 10

Figure 4:
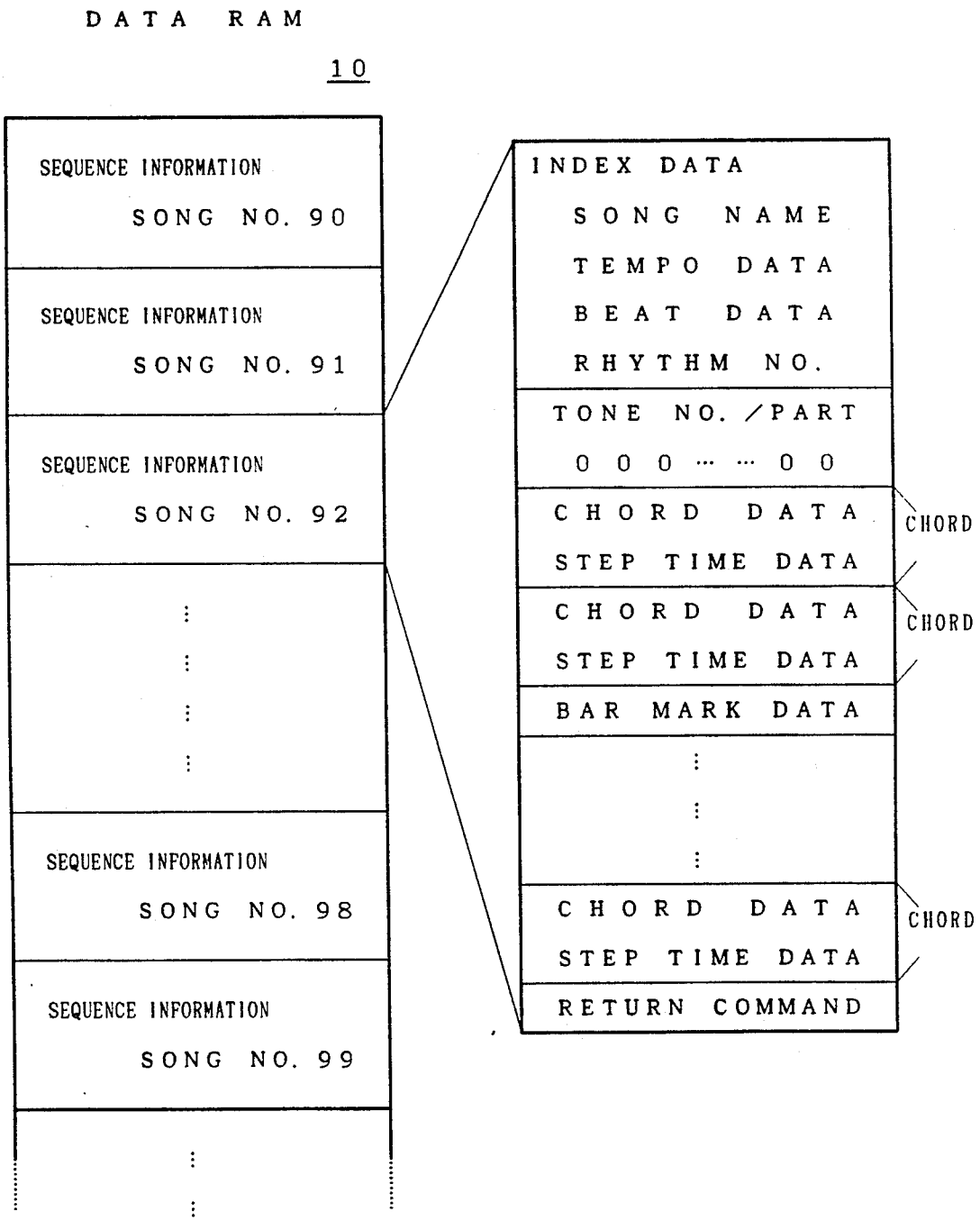
FIG. 4 is a diagram showing the content of a data random-access-memory (data-RAM) 10.

FIG. 4 shows the content of the data RAM 10, wherein the sequence information of 10 pieces of music corresponding to numbers 90 to 99 is stored. In this embodiment, the sequence information includes rhythm part data and chord part data, but melody part data, bass part data, backing part data and arpeggio part data also may be employed as parts of the sequence information and stored in the data RAM 10. Further, the song number is not limited to the numbers of from 90 to 99, and moreover, the number of pieces of music is not limited to 10. Note, the sequence information on pieces of music corresponding to numbers 0 to 89 is stored in the ROM 9 or the ROM/RAM card 12, and can be substituted for the sequence information on 10 pieces of music corresponding to the numbers 90 to 99 without change. Furthermore, the sequence information on pieces of music corresponding to numbers 0 to 89 can be substituted for the sequence information on pieces of music corresponding to the numbers 90 to 99, by a modification or arrangement thereof. Also, sequence information newly input by a player can be used as the sequence information on pieces of music corresponding to the numbers 90 to 99.

The sequence information includes a chord data group consisting of both chord data and step time data, bar mark data, and special commands such as a return command. The chord data represent a chord type and a chord root, and musical tones of a chord indicated by the chord data are sounded by setting musical-sound data representing the musical tones of the chord in the assignment memory (not shown). The step time data indicates a time from a moment corresponding to the first note of a piece of music (i.e., the first note of the first bar of the piece of music), which is represented by bar mark data, to another moment at which a sounding of a musical tone of the piece of music indicated by chord data is started or a command is executed. Namely, if the step time data matches a value indicated by a sequence clock counter 66 (to be described later), a musical tone of the piece of music indicated by the chord data is sounded or a command is executed. The content of this sequence clock counter 66 is incremented at a speed corresponding to an established tempo and is cleared each time clocks corresponding to a bar are counted. The bar mark data indicates a moment corresponding to a bar line of each bar.

Further, index data is stored at a top area of the sequence information, which index data includes rhythm number data, song name data, meter data, and tempo data. The rhythm number data indicates a number of a rhythm pattern stored in the pattern ROM 9, and an automatic performance of this rhythm pattern is effected according to the sequence information. The meter data and the tempo data indicate the meter (or time) and the tempo employed in the automatic performance of this rhythm pattern, respectively. This meter data is stored in a maximum beat number register 51 as data indicating a maximum beat number, and the tempo data is stored in a tempo data register 46. Note, the index data may include the transposition data stored in a transposition data register 45.

The return command is a command used for a return to the beginning of a piece of music, and a repeat of the performance of the piece of music. There are 7 kinds of return commands provided, which are respectively used for an increase in a value indicated by the tempo data, a decrease in a value indicated by the tempo data, an addition of a random value to the value indicated by the tempo data, a decrease in a value indicated by the transposition data, an addition of a random value to the value indicated by the transposition data and a change of a value indicated by the tone number (or timbre) data to a random value. The tempo data, the transposition data and the tone number data are changed each time this return command is input or read.

In addition to the return command, a stop command, an ending command, a "part on/off" command, a variation changing command, a chain song command and a fill-in command are employed as the special commands. The stop command is used to immediately stop an automatic performance: the ending command is used to play an ending pattern stored in the pattern ROM 9, and then stop the automatic performance: the "part on/off" command is used to mask a sounding of a musical tone of each of a melody, rhythm, bass, drum, hat, piano, violin and flute parts (to be described later) or to cancel the masking thereof: the variation changing command and the chain song command are used to change the read sequence information to another kind of sequence information: and the fill-in command is used to effect a fill-in performance of one phrase or several phrases.

5. Sequence Information

Figure 5:
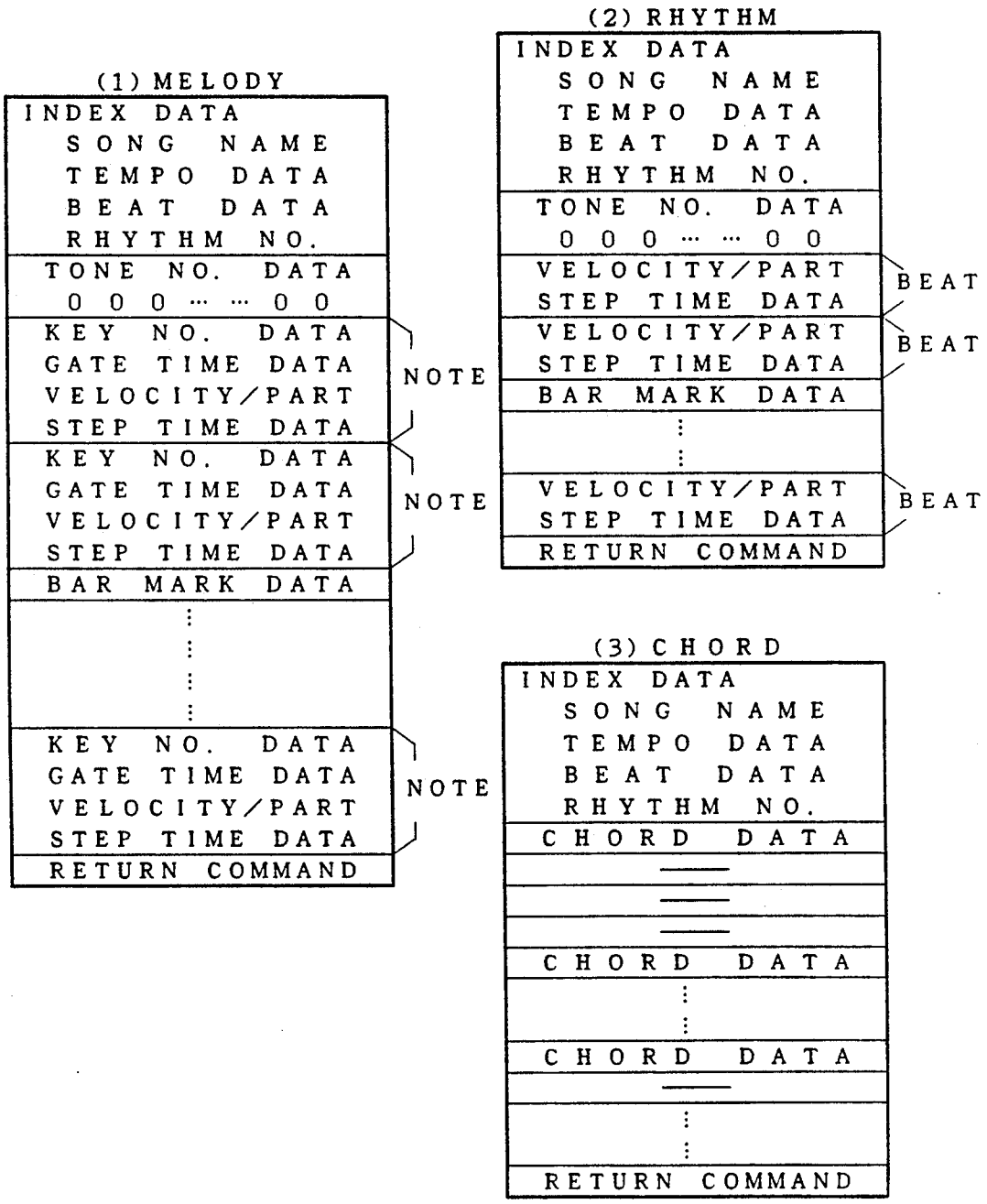
FIG. 5 is a diagram illustrating an example of sequence information.

FIG. 5 shows another example of the sequence information. The sequence information shown in FIG. 5(1) includes a note data group composed of key number (pitch) data, gate time data, velocity data, part data and step time data, and another group composed of bar mark data and tone number data, which are inserted between data of the note data group. The fill-in command is used to effect a fill-in performance of one phrase or several phrases. The sequence information shown in FIG. 5(2) includes a beat data group composed of the velocity data and the step time data, and another group composed of bar mark data and tone number data, which are inserted between the data of the beat data group. Storage areas for storing the sequence information shown in FIG. 5(3) include a group of step areas, (note, 48 steps correspond to a beat,) and chord data is stored in step areas corresponding to steps at which a chord is sounded or changed, and each step area is accessed each step (i.e., 1/48 of a beat) regardless of whether data is stored therein. Further, bar mark data is inserted between such chord data.

Further, the gate time data is used to indicate a time between a moment at which a sounding of a musical tone is started and another moment at which the sounding of the musical tone is finished. The gate time data is decremented when the content of the sequence clock counter 66 (to be described later) is incremented, and when the gate time data becomes equal to 0, a sound absorbing process is effected. The part data is used to indicate the melody, rhythm, bass, drum, hat, piano, violin and flute parts, the tone number data is used to indicate a timbre and is set in a tone number data register 47 of the working RAM 6 (to be described later) while an automatic performance is effected, and the index data is the same as described in FIG. 4. Note, sequence information having a format as shown in FIG. 5(3) may be employed by omitting the step time data. Also, the sequence information may include the special commands.

6. Working Ram 6

Figure 6:
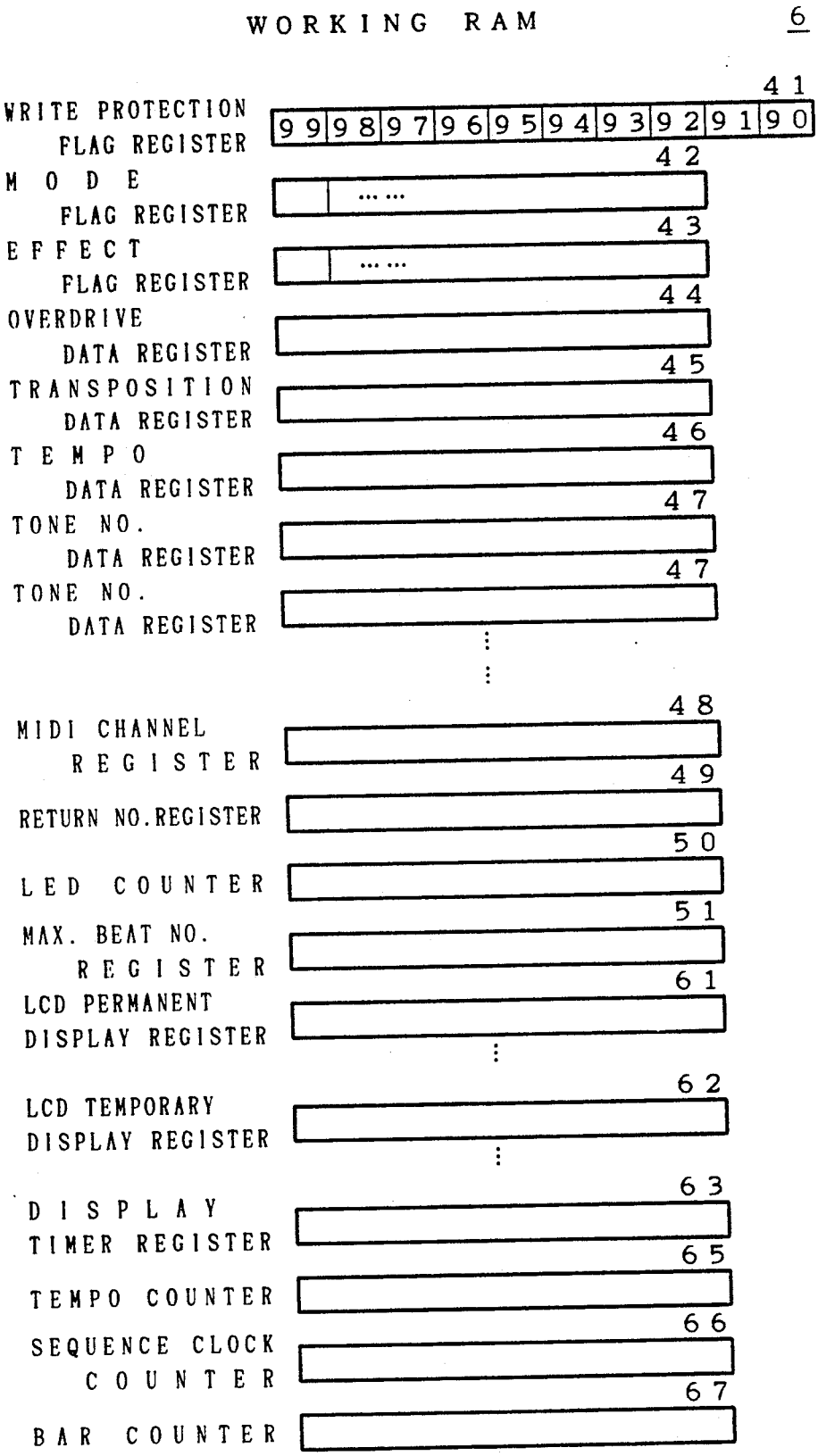
FIG. 6 is a diagram illustrating the content of a working RAM 6.

FIG. 6 shows the content of the working RAM 6. This working RAM 6 includes a write protection flag register 41, a mode flag register 42, an effect flag register 43, an overdrive data register 44, a transposition data register 45, a tempo data register 46, a tone number data register 47, a MIDI channel register 48, a return number register 49, an LED counter 50, a maximum beat number register 51, an LCD permanent display register 61, an LCD temporary display register 62, a display timer register 63, a tempo counter 65, a sequence clock counter 66, and a bar counter 67.

The write protection flag register 41 is a 10-bit register, and a write protection flag corresponding to the sequence information on the 10 pieces of music is stored in each bit area. When the write protection flag indicates 1, the sequence information is protected against writing. Conversely, when the write protection flag indicates 0, the write protection is cancelled. Note, in such cases, the values 1 and 0 may replace each other.

When one of the various modes (e.g., a mode of changing the content of the musical factor of an automatic performance) is established, flag data is set in the mode flag register 42: other mode flags also may be set in this register 42. In the effect flag register 43, bits corresponding to various effects such as an overdrive established by using the OVERDRIVE key 21 are set at 1.

Data indicating a depth of the overdrive input through the volume control 37 is set in the overdrive data register 44, and transposition data input from the "−" key 25*a* and the "+" key 25*b* is set in the transposition data register 45. Data indicating a value of a tempo input through the volume control 38 is set in the tempo data register 46, and decode tempo data obtained by converting the value indicated by the tempo data to a value of ($\frac{1}{2}^{16}$) of (1/48) of a time of a beat is also set in this tempo data register 46.

Tone number data indicating a timbre of a musical tone to be performed according to the sequence information, as well as part data indicating one of performance parts, such as the melody, chord and rhythm parts, is set in the tone number data register 47, and the tone number data is transmitted to the assignment memory together with other data each time a musical tone is sounded. MIDI data input through the MIDI interface 15 and the receiving channel number n is stored in the MIDI channel register 48, and a musical sound corresponding to key number data received by the receiving channel indicated by the receiving channel number is sounded, and key number data received by a channel having a number which is less than the receiving channel number by 1 is sent to the chord memory 16, whereupon the key number data is transformed into a chord.

The number of times the return command is read, i.e., the number of repetitions of the automatic performance according to the sequence information, is stored in the return number register 49. The LED counter 50 is used to count or measure a time for which the LED 8 is made on. Beat data of the sequence information for the automatic performance is set in the maximum beat number register 51, but data obtained by multiplying the beat data by 48 may be stored instead in this register.

Permanent display data to be always displayed by the LCD 7 is stored in the LCD permanent display register 61, and temporary display data to be temporarily displayed by the LCD 7 is stored in the LCD temporary display register 62. Each of these registers 61 and 62 is provided with sufficient storage areas to be able to store characters to be displayed by the LCD 7. The temporary display data is composed of data and commands input by operating the keys 21 to 34 or the volume controls 35 to 38, and is to be displayed. The input data and commands are displayed for only a predetermined time (e.g., 5 seconds) from the operation of the keys or the volume controls, and before and after this time, the permanent display data is displayed. The display timer register 63 is used to count or measure a time for which the temporary display data is displayed.

The decode tempo data of the tempo data register 46 is accumulated by the tempo counter 65, and when the accumulated value exceeds a value corresponding to 1/48 of a beat (i.e., $2^{16}$), and accordingly, an overflow occurs, the content of the sequence clock counter 66 is incremented by 1, and at that time, a sequence performance processing is performed. When a value indicated by the sequence clock counter 66 exceeds a value which is 48 times that of the maximum beat number data, a time of one beat is counted or measured, and consequently, the content of the bar counter 67 is incremented by 1. Further, the rhythm number data and the number of the sequence information used for an automatic performance currently effected are stored in the working RAM 6.

7. Main Routine

Figure 7:
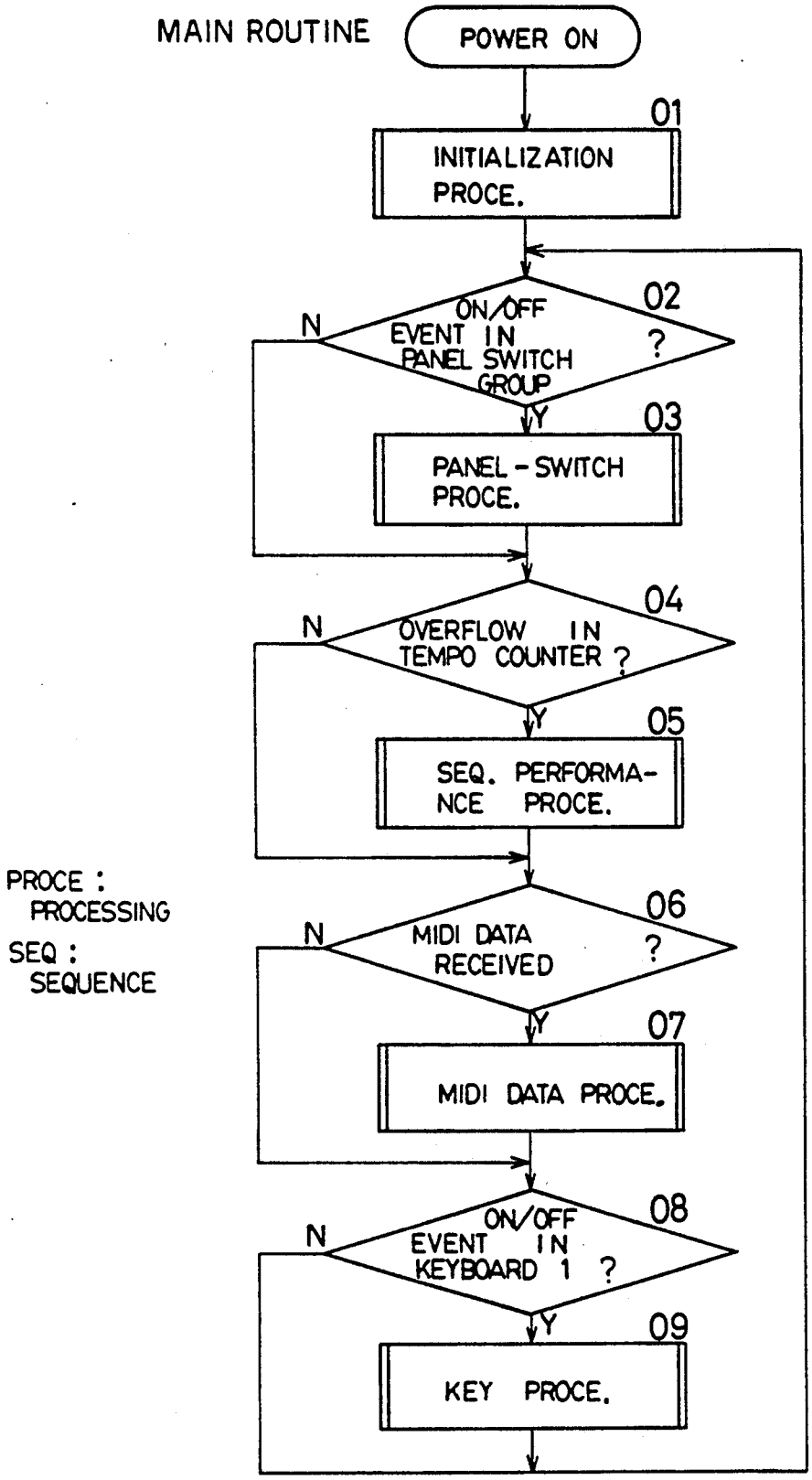
FIG. 7 is a flowchart of a main routine.

FIG. 7 is a flowchart of a main program for performing an entire processing of this embodiment, which processing is started by turning on the power. In this routine, an initialization processing such as a clearing of the working RAM 6 is first performed by the CPU 5 in step 01. Then, if it is detected in step 02 that an on-event or an off-event has occurred at the keys 21 to 34 and the volume controls 35 to 38 (i.e., one of the keys and the control volumes is turned on or off), a panel-switch processing according to input data or commands from the keys 21 to 34 and the volume controls 35 to 38 is effected in step 03. Further, if it is detected in step 04 that an overflow has occurred in the tempo counter 65, a sequence performance is effected in step 05. Next, it is determined in step 06 whether MIDI data has been received and stored in the MIDI interface (I/O) 15, and if this data has been received and stored therein, a processing according to the MIDi data is performed in step 07. Further, if it is detected in step 08 that a key-on event or a key-off event has occurred in the keyboard 1 (i.e., one of the keys of the keyboard 1 is turned on or off), a processing corresponding to the key-on or key-off event is performed in step 09.

8. Sequence Performance Processing

Figure 8:
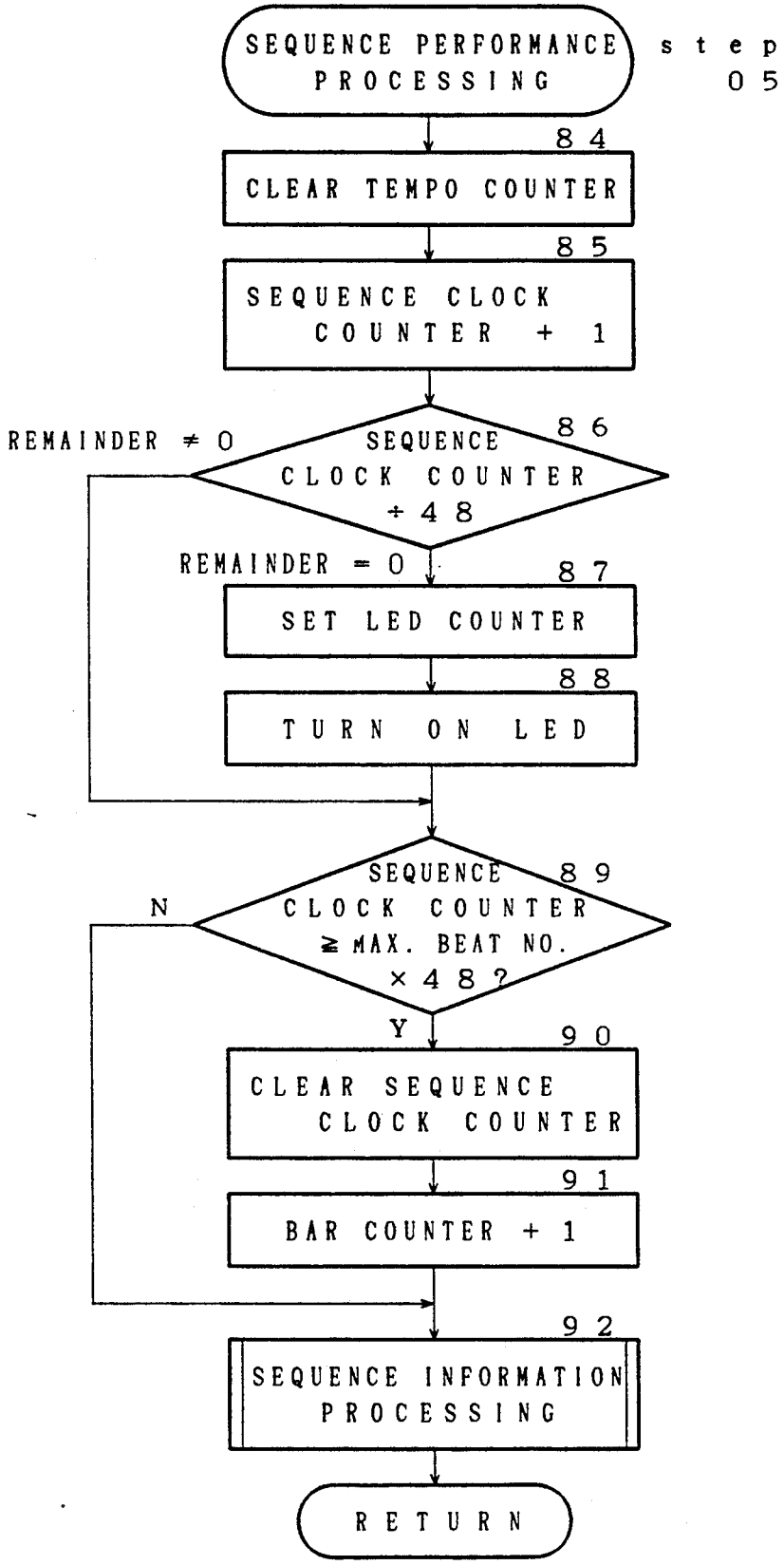
FIG. 8 is a flowchart of a subroutine for performing a sequence performance processing of a step 05 of the main routine.

FIG. 8 is a flowchart of a program for effecting a sequence performance processing of step 05 of FIG. 7. This processing is effected when a period of time of 1/48 of a beat passes since an overflow occurs in the tempo counter 65. Further, two kinds of sequence processing are carried out, i.e., a sequence processing of chords and a sequence processing of rhythm, melody and bass data other than the chords. Namely, after the processing of one of the two kinds of sequence information is completed, the other kind of sequence information is performed. Note, the two kinds of sequence processing are similar to each other, and thus only the sequence processing of chords will be described in detail hereinbelow.

In the sequence processing of chords, the tempo counter 65 is first cleared by the CPU 5 in step 84, and then the content of the sequence clock counter 66 is incremented by 1 in step 85. Subsequently, it is determined in step 86 whether or not a value indicated by the sequence clock counter 66 is divisible by 48, and if a period of time of one beat has passed, it is determined that the value indicated by the sequence clock counter 66 is divisible by 48. If the value indicated by the sequence clock counter 66 is divisible by 48, a value of 11 . . . 1 is set in the LED counter 50 in step 87, and the LED 8 is turned on in step 88. Namely, each time the content of the sequence clock counter 66 is incremented by 48, the state of the LED 8 is changed between an on-state and an off-state thereof.

If the value indicated by the sequence clock counter 66 exceeds a value of 48 times the maximum beat number data stored in the maximum beat number register 51 in step 89, the sequence clock counter 66 is cleared in step 90. Subsequently, the content of the bar counter 67 is incremented by 1 in step 91, and then a processing of the sequence information is performed in step 92. In practice, a reading of chord data included in the sequence information and a transmission of key number data corresponding to composing musical tones of the chord to the assignment memory and the LCD 7 are effected as the processing of the sequence information.

9. Panel-Switch Processing

FIG. 9 is a flowchart of a program for performing the panel-switch processing of step 03 of FIG. 7. In this processing, if it is detected in step 111 that the event-key (i.e., the key turned-on or turned-off) is the EDIT key 29, a value of an edit mode flag of the mode flag register 42 is changed between 0 and 1 in step 112, and then other key processings are performed in step 113. Note, the establishing and cancelling of the mono-chord mode and the setting of the MIDI receiving channel are performed as the other key processings.

Further, if it is detected in step 114 that the event-key is any of the ten keys 32, it is determined in step 115 whether or not the edit mode flag is set. If the edit mode flag is set, it is determined in step 116 whether or not a state exists in which data representing a chord root has been input. This determination is made on the basis of data stored in a cursor display register (not shown) of the working RAM 6. This cursor display register is used to indicate which of the display areas respectively corresponding to 16 characters provided in the LCD 7 is employed to display a cursor. If the value indicated by this register indicates a 12th column, at which the chord root should be displayed, from a left end among 16 columns (i.e., the cursor is displayed at the 12th column) as illustrated in FIG. 16(7), it is determined that a state (hereunder referred to as a chord-root input state) exists in which data indicating a chord root has been input. If the cursor is displayed at a 13th column or at one of columns following thereto, it is determined that a state (hereunder referred to as a chord-type input state) exists in which data indicating a chord type has been input.

If it is detected in step 116 that this embodiment is in a chord-root input state, it is then determined in step 117 whether or not numerical data input from the ten keys 32 is displayed at a first column. If the result is "YES", the numerical data displayed at the first column is temporarily saved in an input buffer register (not shown) in step 118. If the numerical data input from the ten keys 32 is displayed at a second column, the numerical data displayed at the first column is read in step 119. Further, chord root data corresponding to both of the numerical data is read from the chord memory 16 of the pattern ROM 9 and then written to an edit register (not shown) in step 120.

If it is detected in step 121 that a chord-type input state exists, it is then determined in step 122 whether or not numerical data input from the ten keys 32 is displayed at the first column. If the result is YES, the numerical data displayed at the first column is temporarily saved in an input buffer register (not shown) in step 123. If the numerical data input from the ten keys 32 is displayed at the second column, the numerical data displayed at the first column is read in step 124. Further, chord type data corresponding to both of the numerical data is read from the chord memory 16 of the pattern ROM 9 and then written to the edit register (not shown) in step 125.

If it is detected in step 126 that neither a chord-root input state nor a chord-type input state, other data (e.g., bar number data, beat number data and step number data) has been input to another edit register (not shown) according to the position of the cursor in step 127. Thereafter, if the ENTER key 34 is operated in this edit mode in steps 128 and 129, chord data stored in one of the edit registers is transmitted to a sequence information area of the data RAM 10 in step 130. This transmission address of the sequence information area corresponds to the bar number data stored in the other edit register. If this embodiment is not in the edit mode in step 129, an entering processing of other data is performed in step 131. If the edit mode flag is cleared in step 115, an entering processing of data input from the ten keys 32 is performed according to a current mode, in step 132.

The chord type or the chord root thus can be easily input from the ten keys 32. Note, in this case, among the numerical data input from the ten keys 32, numerical values 00 to 11 are assigned to both the chord root and the chord type, as overlapped, but these numerical values 00 to 11 are not necessarily assigned thereto as overlapped. Moreover, the chord root and the chord type may be input from the keys C1 to A1 of the keyboard 1 in step 114. Furthermore, musical tones composing a chord may be sounded by writing key number data corresponding to the musical tones to the assignment memory.

10. Another Example of Panel-Switch Processing

Figure 10:
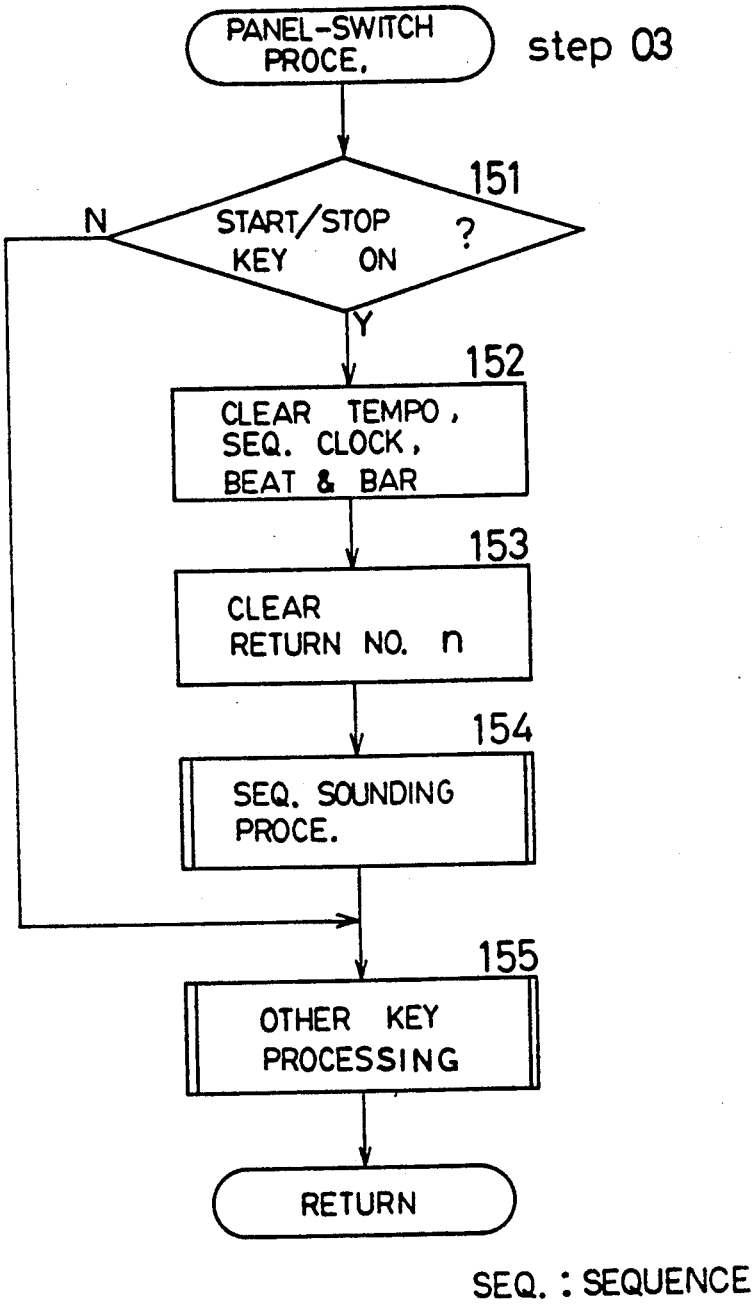
FIG. 10 is a flowchart of another subroutine for performing the panel switch processing.

FIG. 10 is a flowchart of a program for performing another example of the panel-switch processing of step 03 of FIG. 7. In this example, if it is found in step 151 that the event-key is the START/STOP key 26, all of the bar counter 67, the sequence clock counter 66, and the tempo counter 65 are cleared in step 152, and subsequently, the return number data n stored in the return number register 49 is cleared in step 153. Then, a sequence sounding processing, which is the same as performed in step 18, is performed in step 154, and further, a processing corresponding to other keys is performed in step 155.

11. Sequence Information Processing

FIG. 11 is a flowchart of a program for performing the sequence information processing of step 92 of FIG. 8. This processing is performed to change the contents of the musical factors at every return operation carried out during a performance. In this processing, if step time data of musical sound information, which is included in the sequence information and is expected to be next processed, is matched with a value indicated by the sequence clock counter 66, the next musical sound information is read by the CPU 5 in step 11. If a match is not made, a return operation is performed. Where it is detected in step 12 that the read musical sound information is included at the end of the sequence information, and if it is then detected in step 13 that the read musical sound information represents a return command, all of the bar counter 67, the sequence clock counter 66, and the tempo counter 65 are cleared and initialized in step 14.

Further, even where it is detected in step 15 that the return command is a command of the type by which a tempo is changed, if it is detected in step 21 that the return command is also a command of the type by which the tempo data is incremented, the tempo data of the tempo data register 46 is incremented by 5 in step 22. If the return command is a command of the type by which the tempo data is decremented, the tempo data of the tempo data register 46 is decremented by 5 in step 23. If the return command is a command of the type by which a random value is added to the tempo data, the random value is added to the tempo data of the tempo data register 46 in step 24. The random value is determined by performing a random-number generating processing or by using a random-number generating circuit which generates a random value of from −10 to +10.

Subsequently, in step 25, if the value indicated by the tempo data is less than 30, after the operations of steps 22 to 24 are completed, the value indicated by the tempo data is changed to 30. Further, if the value indicated by the tempo data is greater than 240, the value indicated by the tempo data is changed to 240 in step 25. The value indicated by the tempo data is limited to one of values of from 30 to 240 in this way because other values are inappropriate to the value indicated by the tempo data. Note, the value indicated by the tempo data may be set as less than 30 or greater than 240. If the tempo data is changed in this manner, the decode tempo data to be used for realizing a speed corresponding to an actual tempo is also changed, and thus the incrementing of the tempo counter in step 101 (to be described later) is changed, and consequently, the tempo of the performance is changed.

Further, even where it is detected in step 16 that the return command is a command of the type in which the transposition data is changed, if the return command is a command of the type by which the transposition data is incremented, the value indicated by the transposition data stored in the transposition data register 45 is incremented by 1 in step 32. If the return command is of the type by which the value indicated by the transposition data is decremented, the value indicated by the transposition data register 45 is decremented by 1 in step 33. If the return command is of the type by which a random value is added to the value indicated by the transposition data, a random value is added to the value indicated by the transposition data stored in the transposition data register 45 in step 34. This random value is determined by a random value generating circuit, which randomly generates values of, for example, −1, 0 or +1, or by performing a random value generating processing.

Further, if the value indicated by the tempo data is less than −12 after the operations of steps 32 to 34 are finished, the value indicated by the tempo data is set to be −12 in step 35. If this value is greater than +12, the value indicated by the tempo data is set to be +12 in step 35. Note, the value indicated by the transposition data may be set as less than −12 or greater than +12. If the transposition data is changed in this way, the transposition data obtained as a result of the change is added to the key number data at a moment at which a musical tone is next sounded, data obtained as a result of the addition is sent to the assignment memory together with tone number data and touch data, and thus a pitch of the musical tone is changed and then the musical tone is sounded. Note, the operations of steps 22 to 24 and 32 to 34 may be an addition, a subtraction, a multiplication or a division and may be performed on the basis of equations, for example, D+a*n and D+sin (a*n) where D denotes initial data; a a constant; and n the number of times return operations are effected.

Moreover, if the return command is of the type by which the tone number is changed, one of the bass, chord and melody parts is selected on the basis of a first random value in step 41, and then a second random value is set in the tone number register 47 corresponding to the part selected in step 42. The first and second random values are determined by a random value generating circuit or by performing a random value generating processing. Furthermore, if the tone number is changed in this way, the key number data and the touch data are sent to the assignment memory at a moment at which a musical tone is next sounded, together with the tone number data obtained as a result of the change, and consequently, the pitch of the musical tone is changed and is then sounded.

Note, the change of the tone number may be performed only on tone numbers corresponding to sounds generated by rhythmic or percussion parts to be played by drums, a hat or cymbals, but alternatively, tone numbers respectively corresponding to all performance parts may be changed in a lump. Such a change in the timbre of a musical sound may be effected as in steps 21 to 25 and 31 to 35. Conversely, the tempo and the transposition data may be changed as in steps 41 and 42. Note, when the random value used in steps 24, 34 and 42 becomes equal to 0 or equal to the tone number used until then, the values indicated by the data are not changed.

If it is found in step 12 that the musical sound information of the read sequence information is not information included at the end of the sequence information, a sounding processing is performed according to the musical sound information in step 18. This sounding processing is used to write the key number data, the tone number data, the velocity data, the part data, and the on/off data corresponding to the musical sound information to the assignment memory, and subsequently, sound the corresponding musical tones. At a moment of sounding the musical tone, the on/off data is placed in an on-state, and when a time indicated by the gate time data has passed and the sound is absorbed, the on/off data is placed in an off-state. When performing a sounding processing of the chord data, the key number data is changed to that corresponding to musical sounds composing the chord. In the case of the bar mark data, a corresponding flag is first set and then the sequence performance is stopped. Thereafter, if the sequence clock counter 66 is cleared at the beginning of the next bar, the flag is cleared and the sequence performance is resumed.

Further, if it is detected in step 13 that the musical sound information included at the end of the sequence information does not relate to a return command, a performance ending processing is effected in step 19. In this performance ending processing, if the command is for the instrument to stop the performance, the performance is immediately ended. If the command is for the instrument to play ending phrases, the sequence information relating to an ending phrase or to several ending phrases stored in the pattern ROM 9 is read therefrom, and such ending phrases are performed, and then the performance is finished.

12. Another Example of the Sequence Information Processing

FIG. 12 is a flowchart of a program for performing another example of the sequence information processing of step 92 of FIG. 8. In this example of the sequence information processing, the musical factors are changed according to the number of times a return operation is effected during the performance. The processing described in the flowchart of FIG. 12 is substituted for the processing of steps 15 to 42 of FIG. 11. Namely, the processing of steps 11 to 14, 18 and 19 of FIG. 11 is performed in this example.

In this example, the return number data n stored in the return number register 49 is first incremented by 1 by the CPU 5 in step 61. If it is detected in step 62 that the return command is of the type by which the tempo is changed, a value expressed by a function f(n) involving the return number data employed as a variable n is added to the tempo data stored in the tempo data register 46, in step 63. For example, the following functions may be employed as the function f(n); i.e., $f(n)=an^b$, $f(n)=cn$, $f(n)=SQR(dn)$, $f(n)=e/SQR(fn)$, $f(n)=g/n$, $f(n)=h/n^1$, $f(n)=\log_j(kn)$, $f(n)=1/\log_m(pn)$ and $f(n)=\sin(qn)$ where SQR denotes a square root and each of characters a to q designates a constant. Thereafter, a same processing as that of step 25 of FIG. 11 is performed in step 64.

Further, if it is found in step 65 that the return command is of the type by which the transposition data is changed, a value indicated by a function g(n) is added to the transposition data stored in the transposition data register 45 in step 66. Similar to the case of the function f(n), various functions may be employed as the function g(n). Thereafter, a same processing as that of step 35 of FIG. 11 is performed in step 67.

Moreover, if it is detected in step 68 that the return command is of the type by which the tone number is changed, a value indicated by another function h(n) is set as the tone number data stored in the tone number data register 47 in step 69. Similar to the case of the function f(n), various functions may be employed as this function h(n). Note, the tempo data and the transposition data may be changed in the same way as in step 69, and further, the timbre data may be changed in the same way as in steps 63, 64, 66 and 67.

Further, the return command may be stored or included in the sequence information of a piece of music. Moreover, as the result of executing the return command, the performance may be returned to a position other than the beginning of the piece of music. In such a case, a bar number (hereunder referred to as a destination bar number), to which the performance is returned, is included in the return command. Further, in the processing described in the flowcharts of FIGS. 11 and 12, the destination bar number is set in the bar counter 67 prior to the return thereto. Moreover, the number m of times of return operations effected in accordance with the return commands may be a predetermined value. In this case, the number m of times of return operations, as well as the return command, is prestored in the instrument. Further, it is determined, prior to the return described in the flowchart of FIG. 12, whether or not the value indicated by the return number data n stored in the return number register 48 exceeds the number m of times of return operations. If the value indicated by the return number data n exceeds the number m, the performance does not return to the destination but instead the information subsequent to the return command is read out. If the value indicated by the return number data n does not exceed the number m, the performance returns to the destination.

Furthermore, even if the tempo data, the transposition data, and the tone number data are changed at the time of the return operation, the tempo data, the transposition data, and the tone number data must be again changed when the tempo data, the transposition data, and the tone number data are inserted to the sequence information. Further, when the tone number data is changed in steps 41, 42, 68 and 69, the musical sounds of the part selected according to the random value may be masked. This part may be any of the performance parts (e.g., the melody part, the chord part, and the rhythm part) and musical instrument sound parts (e.g., the piano part, the violin part, the drum part, the hat part, and the cymbals part). In this case, even if the corresponding tone number and part number data are read from the sequence information when the masking is effected, this musical sound data is not written to the assignment memory. Note, the part number data is a kind of index data included in the sequence information.

13. Still Another Example of the Sequence Information Processing

FIG. 13 is a flowchart of a program for performing still another example of the sequence information processing of step 92 of FIG. 8. In this example, if the next step time data is matched with the value indicated by the sequence clock counter 66, the next information element area is accessed in step 51 to read out the next musical-sound information. Conversely, if the data is not matched, this program returns to the program of FIG. 8. If it is found in step 52 that there is no musical sound information in the accessed area, the program returns thereto, but if it is found in step 52 that there is musical sound information in the accessed area, it is further determined in step 53 whether or not the musical sound information stored in the accessed area is information included at the end of the sequence information. If so, the return and the ending processing are performed in step 54, and if not, it is determined that the musical sound information stored in the accessed area is chord data.

Subsequently, data corresponding to the key number data of the musical tones composing this chord is set in the assignment memory and the automatic performance of this chord is effected in step 55 by performing a sounding processing of the musical tones composing this chord, and thereafter, the data is written to storage areas of the LCD permanent display register 61 in step 57. These storage areas to which the data are written correspond to the fifth to eighth characters displayed at the LCD 7.

In the sounding processing of step 55, the key number data, the tone number data, the velocity data, the part data, and the on/off data are written to the assignment memory and the corresponding musical tones are sounded. At a moment of sounding the musical tones, the on/off data is placed in an on-state, and when a time indicated by the gate time data has passed and the sound is absorbed, the on/off data is placed in an off-state. When performing a sounding processing on the chord data, the key number data is changed to that corresponding to musical tones composing the chord. In the case of the bar mark data, the corresponding flag is first set and then the sequence performance is stopped. Thereafter, if the sequence clock counter 66 is cleared at the beginning of the next bar, the flag is cleared and the sequence performance is resumed.

Next, the step time data corresponding to the chord data next to a current reading address of the sequence information is read in step 58, and then it is determined in step 59 whether or not the value indicated by the step time data is greater than the value of the data of one bar. If this value is smaller, the next chord data is read out and is written to storage areas of the LCD permanent display register 61 in step 60. These storage areas correspond to the 11th to 14th characters displayed at the LCD 7. At that time, data representing "→" is also written to a storage area corresponding to the 9th character displayed at the LCD 7. Accordingly, the chord currently played, as well as the chord to be played next, is displayed thereat as shown in FIG. 16(2), and thus the chord to be played next can be known in advance.

Further, if it is found in step 59 that the value indicated by the step time data is greater than the value indicated by the data of one bar, the processing of step 60 is not performed. Therefore, as illustrated in FIG. 16(3), when a current chord is played for a time corresponding to one bar or more, the chord to be played next is not displayed, and accordingly, it can be seen that the current chord is to be played for a while.

Note, the data to be compared with the step time data in step 59 may be data of two bars or more instead of the data of one bar. Further, the processing of step 55 may be selected according to a mode set by using the keys 21 to 34 or the volume controls 35 to 38. If the processing of step 55 is not performed, a chord performance can be practiced by using the keyboard 1 with reference to a chord displayed at the LCD 7. Furthermore, the processing of steps 58 to 60 may be modified as follows. Namely, the next chord data is first read in step 58, and then the read chord data is compared with the chord data read in step 51 and representing the chord currently performed. If a match is not made, the program advances to step 60, but if a match is made, the program returns to that of FIG. 8. Alternatively, the processing of steps 58 to 60 may be changed as follows. Namely, the next information is first read in step 58, and if the thus-read next information is not bar mark data, the program advances to step 60, but if the thus-read next information is bar mark data, the program returns to that of FIG. 8.

14. MIDI Data Processing

FIG. 14 is a flowchart of a program for performing the MIDI data processing of step 07 of FIG. 7. In this processing, it is determined by the CPU 5 in step 41 whether or not the number of the channel receiving the musical sound data input through the MIDI interface 15 is (n−1), which is less by one than the MIDI receiving channel number n stored in the MIDI channel register 48. If the result is YES, it is further determined in step 42 whether or not the received musical sound data is key-on event data, and if so, it is further determined in step 43 whether or not the corresponding key number data indicates the pitches of from C1 to B1 (corresponding to the values of from 36 to 47).

If the key number data represents the pitches C1 to B1, the chord root data corresponding to the key number data is read from the chord memory 16 of the pattern ROM 9 and is next written to the edit register (not shown) in step 44. Further, if it is detected in step 45 that the key number data represents the pitches C2 to A5, the chord type data corresponding to the key number data is read from the chord memory 16 of the pattern ROM 9 and then written to the edit register (not shown) in step 46. Furthermore, key number data indicating the musical tones composing a chord, corresponding to the chord type and the chord root stored in the edit registers, is written to the assignment memory and the musical tones composing the chord are sounded in step 46, and thereafter, the current performance is switched to a performance of this chord.

Note, if the chord type data has been written to the edit register in step 44, the content of the chord performance is updated at that moment. Further, when the number of the channel receiving the musical sound data input through the MIDI interface 15 is not (n−1) (step 41), the received musical sound data is not converted into chord data and an ordinary sounding processing is effected (step 47).

In this way, the chord root data and the chord type data can be easily input only by inputting two key number data (corresponding to pitches). This processing of steps 42 to 46 can be performed regardless of whether the instrument is in the mono-chord mode, but the instrument may be controlled such that the processing of steps 42 to 46 can be performed only in the mono-chord mode.

Note, the program may be modified as follows. Namely, the discrimination of the numerical data is effected in step 42, and then the conversion of the numerical data to the corresponding chord-type and chord-root data is performed in steps 43 to 46. This processing of steps 43 to 46 may be performed in the key processing of step 09 and the panel-switch processing of step 03.

15. Interrupt Processing Performed at Regular Intervals

Figure 15:
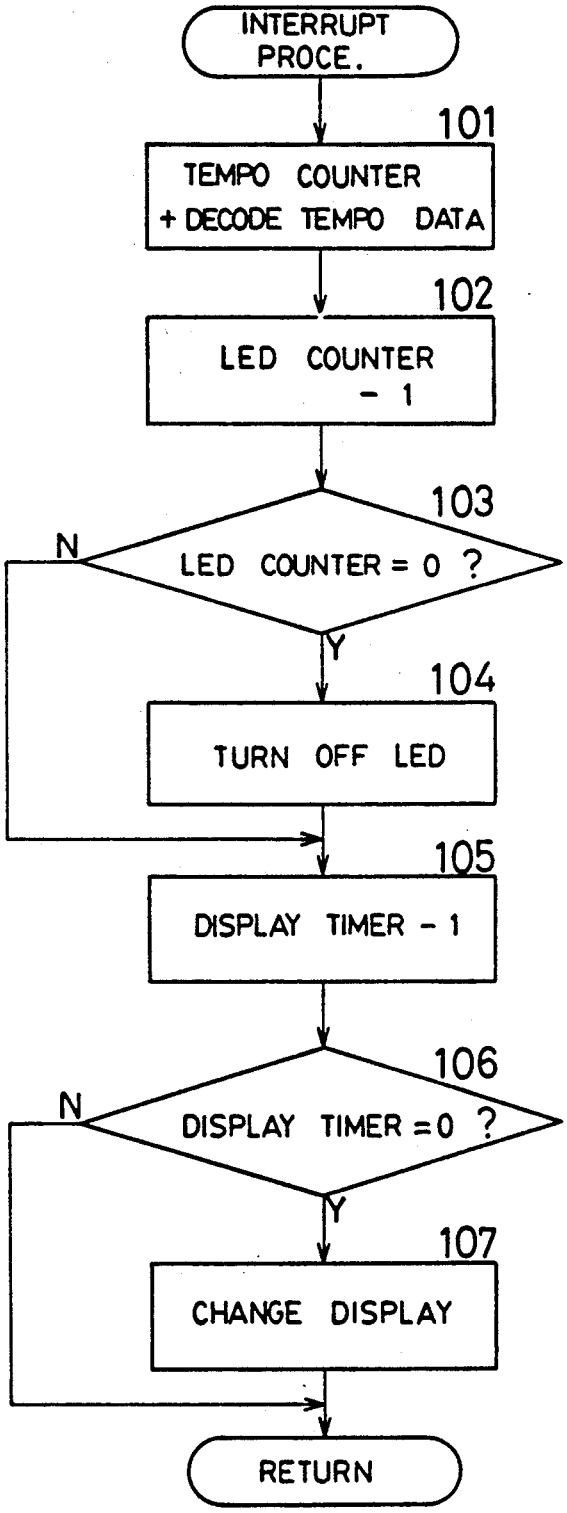
FIG. 15 is a flowchart of a program for performing an interrupt processing at regular intervals.

FIG. 15 is a flowchart of a program for performing an interrupt processing to be performed at regular intervals. This processing is effected when an interrupt signal, which is periodically output at regular intervals independently of the established tempo by performing a timer processing of counting clock signals used for controlling the entire electronic musical instrument, is applied to the CPU 5.

In this processing the decode tempo data stored in the tempo data register 46 is accumulated by the CPU 5 in the tempo counter 65 in step 101, and then the data set in the LED counter 50 in step 87 is decremented by 1 in step 102. This decrementing operation is performed each time the interrupt processing is effected, and therefore, when a certain period of time has passed, the value indicated by the LED counter becomes 0. If it is detected in step 103 that the value indicated by the LED counter 50 is 0, the LED 8 is turned off in step 104, and accordingly, a change of the state of the LED 8 between an on-state and an off-state is performed at regular intervals, regardless of the established tempo.

Subsequently, the time data set in the timer register 63 in steps 14 and 18 is decremented in step 105. This decrementing processing is also effected each time the interrupt processing is performed, and therefore, after the lapse of a certain period of time (in this case, 5 seconds), the value indicated by the display timer register 63 becomes 0. If it is detected in step 106 that the value indicated by the display timer register 63 has become 0, the data set in the LCD temporary display register 62 in steps 13 and 17 is cleared, and further, the data stored in the LCD permanent display register 61 is sent to the LCD 7 in step 107. Accordingly, the transposition data is displayed for only 5 seconds after the operation of the "−" key 25*a*, the "+" key 25*b* or the OVERDRIVE key 21, and thereafter, the originally displayed data is again displayed.

16. Examples of Display at LCD 7

FIG. 16 illustrates the display states of the LCD 7. As shown in the FIG. (1) when the automatic performance mode is established, a song number "00" and a song name "Z&Roll" and a first chord "A7" included in the sequence information are displayed as shown in FIG. 16(1): (2) during an automatic performance, a chord "Am" currently played and another chord "Eaug" next to be played are displayed as shown in FIG. 16(2); (3) if the same chord (e.g., "E7") is played during the automatic performance, only the same chord "E7" is displayed as illustrated in FIG. 16(3). Note in the cases (1) and (2), the song number "00" is displayed. Then (4) when the "−" key 25*a* and the "+" key 25*b* are operated, the transposition data "Transpose" and "+1" are temporarily displayed as illustrated in FIG. 16(4); (5) when the OVERDRIVE key 21 is operated, the expression "Overdrive" and the data ("on") indicating an on-state or off-state (an on-state in this case) thereof are temporarily displayed as illustrated in FIG. 16(5): (6) when the write protection mode is established, the write protection state of each sequence information is indicated as illustrated in FIG. 16(6). Note, in the case of the example of FIG. 16(6), the write protection is applied to the sequence information concerning the song numbers "91", "97" and "99". Then (7) when the chord edit mode is selected, the numbers of bars, beats, and steps, the chord root and the chord type are displayed as illustrated in FIG. 16(7). Note, in the case of the example of FIG. 16(7), it is indicated that the performance chord is changed to Adim (A diminished) at step 00 ("00") of a first beat ("1") of a second bar ("002"), and this display is continuously performed.

Although a preferred embodiment of the present invention has been described above, it is understood that the present invention is not limited thereto, and that other modifications will be apparent to those skilled in the art without departing from the spirit of the invention. For example, the musical-factor changing processing of steps 21 to 15, 31 to 35, 41 and 42 also may be performed on the sequence information of FIG. 5. Further, such a processing can be applied to touch data (velocity data), volume data, data indicating a depth of modulation, data indicating change in a rate of included harmonic components, data indicating the contents of effects, data to be used for selecting a musical-sound waveform, and data to be used for selecting an envelope waveform. Furthermore, sequence information of one or several bars, or of one or several phrases, or of one or several motifs may be employed as the sequence information to be stored in the data RAM 10, instead of the sequence information of one piece of music. Moreover, the sound system 13 may be omitted, and in such a case, the data to be written to the assignment memory or the sequence information is output through the MIDI interface 15.

In addition, alphabet keys, symbol keys or kana keys may be employed as the keys to be used for inputting chord data, instead of the ten keys 32.

The scope of the present invention, therefore, is to be determined solely by the appended claims.

What is claimed is:

1. A musical-factor data changing device for use in an electronic musical instrument, said musical-factor data changing device comprising:

storage means for storing a plurality of performance information;

reading means for reading the plurality of performance information from said storage means in a performance progression order;

performance means for performing a piece of music according to the plurality of performance information read by said reading means;

repeating means for causing said reading means to repeat a reading of the plurality of performance information;

detection means for detecting a repetition by said repeating means; and changing means for changing musical-factor data representing a musical factor associated with the plurality of performance information, based on each detection of the repetition by said detection means.

2. The musical-factor data changing device according to claim 1, wherein said changing means further stores the musical-factor data, and changes the musical-factor data based on each detection of the repetition by said detection means, and outputs the musical-factor data to said performance means.

3. The musical-factor data changing device according to claim 1, wherein said changing means changes the musical-factor data according to a number of repetitions detected by said detection means.

4. The musical-factor data changing device according to claim 1, wherein the musical factor data represents a tempo of the piece of music.

5. The musical-factor data changing device according to claim 1, wherein the musical factor data represents a pitch of the piece of music.

6. The musical-factor data changing device according to claim 1, wherein the musical factor data represents a timbre of the piece of musical.

7. A chord processing device for use in an electronic musical instrument, said chord processing device comprising:

character-data input means for inputting character data;

first conversion means for converting the character data input by said character-data input means in a chord-root input state into chord type data representing a type of a chord to be performed;

second conversion means for converting the character data input by said character-data input means in a chord-type input state into chord root data representing a root of the chord;

first output means for outputting the chord type data converted by said first conversion means;

second output means for outputting the chord root data converted by said second conversion means; and chord processing means for processing the chord type data output by said first output means and the chord root data output by said second output means.

8. The chord processing device according to claim 7, said character-data input means further comprising chord-type input means for inputting chord type data and chord-root input means for inputting chord root data.

9. The chord processing device of claim 7, wherein said character-data input means in said chord-root input state is separated from said character-data input means in said chord-type input state.

10. A chord processing device for use in an electronic musical instrument, said chord processing device comprising:

a plurality of pitch input means for inputting pitch data;

chord-type conversion means for converting the pitch data input by only one of the plurality of pitch input means into chord type data, representing a type of chord to be performed;

chord-root conversion means for converting the pitch data input by only another one of the plurality of pitch input means, separate from the pitch input means for the chord type data, into chord root data, representing a root of the chord to be performed;

first output means for outputting the chord type data converted by said chord-type conversion means;

second output means for outputting the chord root data converted by said chord-root conversion means; and chord processing means for processing the chord type data output by said first output means and the chord root data output by said second output means.

11. A chord processing device for use in an electronic musical instrument, said chord processing device comprising:

chord storing means for storing chord type data representing types of chords and chord root data representing roots of chords;

display means for displaying the types of chords and the roots of chords;

first reading means for reading the chord type data and the chord root data from said chord storing means in order of progress of an automatic performance;

first display controlling means for controlling said display means to display the chord type data and the chord root data read by said first reading means;

second reading means for reading chord type data and chord root data, respectively, subsequent to the chord type data and the chord root data read by the first reading means; and second display controlling means for controlling said display means to display the chord type data and the chord root data read by said second reading means.

12. The chord processing device according to claim 11, wherein, only if the chord type data and the chord root data read by the first reading means are stored in the chord storing means separate from the subsequent chord type data and the subsequent chord root data by one or more bars, respectively, said second display controlling means controls said display means to display the subsequent chord type data and the subsequent chord root data and the second reading means reads the subsequent chord type data and the subsequent chord root data.

13. The chord processing device according to claim 11, wherein only if the chord type data and the chord root data read by the first reading means do not match the subsequent chord type data and the subsequent chord root data, respectively, the second display controlling means controls said display means to display the subsequent chord type data and the subsequent chord root data and the second reading means reads the subsequent chord type data and the subsequent chord root data.

14. A chord processing device for use in an electronic musical instrument said chord processing device comprising:

chord storing means for storing chord type data representing types of chords and chord root data representing types of chords and chord root data representing roots of chords;

display means for displaying the types of chords and roots of chords;

first reading means for reading the chord type data and the chord root data from the chord storing means in order of progress of an automatic performance;

second reading means for reading chord type data and chord root data, respectively, subsequent to the chord type data and the chord root data read by the first reading means; and display controlling means for controlling the display means to simultaneously display the chord type data and chord root data read by said first reading means and the subsequent chord type data and chord root data read by said second reading means.

15. The chord processing device according to claim 14, wherein, only if the chord type data and the chord root data read by said first reading means are stored in said chord storing means separate from the subsequent chord type data and the subsequent chord root data storage by one or more bars, respectively, said display controlling means controls said display means to display the subsequent chord type data and the subsequent chord root data and said second reading means reads the subsequent chord type data and the subsequent chord root data.

16. The chord processing device according to claim 14, wherein only if the chord type data and the chord root data read by said first reading means do not match the subsequent chord type data and the subsequent root data, respectively, said display controlling means controls said display means to display the subsequent chord type data and the subsequent chord root data and said second reading means reads the subsequent chord type data and the subsequent chord root data.

17. A method of changing a musical-factor data in an electronic musical instrument comprising the steps of:

(A) storing a plurality of performance information;

(B) reading the performance information stored in said step (A) in order of progress of an automatic performance;

(C) performing a piece of music according to the performance information read in said step (B);

(D) repeating a reading of the performance information read in said step (B);

(E) detecting a repetition in said step (D); and (F) changing the musical-factor data representing musical factor associated with the performance information, based on the detection of the repetition in said step (E).

18. The method of changing a musical-factor data in an electronic musical instrument according to claim 17, wherein said step (F) includes the substeps of, (F) (1) storing the musical-factor data, (F) (2) changing the musical-factor data based on each detection of the repetition in said step (E), and (F) (3) outputting the musical-factor data.

19. The method of changing a musical-factor data in an electronic musical instrument according to claim 17, wherein said step (F) includes changing the musical-factor data according to the number of repetitions detected in said step (E).

20. The method of changing a musical-factor data in an electronic musical instrument according to claim 17, wherein the musical-factor data represents a tempo, a pitch, and a timbre of the piece of music.

* * * * *